US011414223B2

(12) United States Patent
Klarner et al.

(10) Patent No.: US 11,414,223 B2
(45) Date of Patent: Aug. 16, 2022

(54) SYSTEM AND METHOD FOR OPTIMIZING THE HEIGHT OF A BOX FOR SHIPPING

(71) Applicant: Ranpak Corp., Concord Township, OH (US)

(72) Inventors: Uwe Klarner, Saint Epain (FR); Remi Parisse, Hauteville les Dijon (FR); Jean-Yves Sia, Saint Gervais les Bains (FR)

(73) Assignee: Ranpak Corp., Concord Township, OH (US)

( * ) Notice: Subject to any disclaimer, the term of this patent is extended or adjusted under 35 U.S.C. 154(b) by 0 days.

(21) Appl. No.: 16/765,212

(22) PCT Filed: Nov. 27, 2018

(86) PCT No.: PCT/US2018/062606
§ 371 (c)(1),
(2) Date: May 19, 2020

(87) PCT Pub. No.: WO2019/104321
PCT Pub. Date: May 31, 2019

(65) Prior Publication Data

US 2020/0283175 A1 Sep. 10, 2020

Related U.S. Application Data

(60) Provisional application No. 62/591,004, filed on Nov. 27, 2017.

(51) Int. Cl.
*B65B 7/20* (2006.01)
*B65B 7/28* (2006.01)
*B65B 57/12* (2006.01)

(52) U.S. Cl.
CPC ..... *B65B 7/20* (2013.01); *B65B 7/2807* (2013.01); *B65B 7/2871* (2013.01); *B65B 57/12* (2013.01); *B65B 2210/04* (2013.01)

(58) Field of Classification Search
CPC ..... B65B 7/20; B65B 2210/04; B65B 57/12; B65B 7/2871; B65B 7/2814
See application file for complete search history.

(56) References Cited

U.S. PATENT DOCUMENTS 3,673,764 A 7/1972 Bell
3,967,434 A 7/1976 Mancini
(Continued)

FOREIGN PATENT DOCUMENTS

CN 101801794 A 8/2010
JP S58216521 A 12/1983
(Continued)

OTHER PUBLICATIONS

International Search Report and Written Opinion dated Apr. 29, 2019 for PCT/US2018/062606.
(Continued)

*Primary Examiner* — Eyamindae C Jallow
*Assistant Examiner* — Himchan Song
(74) *Attorney, Agent, or Firm* — Renner, Otto, Boisselle & Sklar, LLP

(57) ABSTRACT

A system for closing a shipping container that has a rectangular bottom wall, upstanding side walls extending from the periphery of the bottom wall, and an open top end, includes a sled capable of moving the container between a first station and a second station spaced from the first station, and a flap-folding assembly movable with the sled. The flap-folding assembly is configured to inwardly fold flaps of the container while the sled moves the container between the first station and the second station.

8 Claims, 34 Drawing Sheets

(56) References Cited

U.S. PATENT DOCUMENTS

| | | | | |
|---|---|---|---|---|
| 3,981,123 | A * | 9/1976 | Flanagan | B65B 51/023 118/DIG. 3 |
| 4,262,469 | A * | 4/1981 | Ooms | B65B 7/20 53/76 |
| 4,524,560 | A * | 6/1985 | Goodman | B65B 7/20 53/377.3 |
| 6,070,396 | A * | 6/2000 | Rinaldi | B65B 7/20 493/23 |
| 2005/0126123 | A1* | 6/2005 | Chase | B65B 7/20 53/504 |
| 2009/0031676 | A1* | 2/2009 | Boigues | B65B 59/001 53/376.4 |
| 2011/0177928 | A1* | 7/2011 | Fallas | B65B 7/20 493/180 |
| 2017/0247129 | A1* | 8/2017 | Menta | B65B 59/003 |

FOREIGN PATENT DOCUMENTS

| | | | |
|---|---|---|---|
| JP | 40002234 | | 10/2007 |
| WO | 1997015495 | A1 | 5/1997 |
| WO | 2016151310 | A1 | 9/2016 |

OTHER PUBLICATIONS

International Preliminary Report on Patentability dated Jun. 2, 2020 for International Patent Application No. PCT/US2018/062606.

* cited by examiner

SYSTEM AND METHOD FOR OPTIMIZING THE HEIGHT OF A BOX FOR SHIPPING

RELATED APPLICATIONS

This is a national phase of International Patent Application No. PCT/US2018/062606, filed Nov. 27, 2018 and published in the English language, and which claims priority to U.S. Provisional Patent Application No. 62/591,004 filed Nov. 27, 2017, both of which are hereby incorporated herein by reference in their entireties.

FIELD OF THE INVENTION

This invention relates generally to a system and method for optimizing the height of a shipping container, and may include systems and methods for forming custom flaps in a container based on a height of the contents.

BACKGROUND

In the process of shipping an item from one location to another, a protective packaging material is typically placed in the shipping case, or box, to fill any voids or to cushion the item during the shipping process. These packaging materials also may be referred to as "dunnage" or "dunnage products." To minimize or eliminate the amount of dunnage required to protect the items being shipped and to optimize the shipping volume, machines and techniques have been developed to reduce the height of the container, typically a cardboard box, to a height that is closer to the height of the contents. Shipping containers generally are made of corrugated cardboard. An exemplary shipping container 20 is shown in FIG. 1 and has a rectangular bottom wall, an open top side and vertical side walls extending from the perimeter of the bottom wall. Items to be shipped are placed in the container 20 through the open top side, which then must be closed for shipment.

A typical prior art system 25 is shown schematically in FIG. 2. A conveyor 26 moves containers 20 through multiple stations 27, 28, 29, 30, and 31 in sequence under the control of a controller 32. A height of the contents in a container 20 is detected at a first station 27, the container 20 moves to a second station 28 where vertical slits are made at corners of the container 20 to a desired height, and then at a third station 29 horizontal fold lines are formed in side walls of the container 20 to create flaps that can be folded inwardly over the contents. The flaps are folded inwardly at a fourth station 30, and then at a fifth station 31 a lid is placed over the top of the flaps to close the container 20. See, for example, U.S. Patent Application Publication No. 2009/0031676 A1.

An exemplary lid blank 33 is shown in FIG. 3. The lid blank 33 has a rectangular main portion 34 sized to cover the open top side of the container 20, and respective pairs of tabs 35 and 36 extending from the main portion 34 that are folded down over the side walls of the container 20 to form a lid that is secured to the container 20 to hold the lid in place for shipment. The lid blank 33 optionally may include fold lines formed between the main portion 34 and the tabs 35 and 36.

SUMMARY

The present invention provides an improved system and method for optimizing the height of a shipping container based on a height of the contents, that minimizes the time and number of stations needed to size and close an open-topped shipping container, such as by forming flaps at the open top side of the container based on the height of the contents, and then inwardly folding the flaps while advancing the container. The open top side of the container may be closed by the flaps or by attaching a separate lid over the open top of the container. Another aspect of the invention provides a unique assembly for forming flaps in the shipping container to a height based on the height of the contents of the container, and that is adjustable to accommodate different size containers. By moving containers through the system while inwardly folding the flaps, the present invention provides a system that reduces or minimizes both the size of the system and the time needed to close the container.

More particularly, the present invention provides a system for closing a shipping container that has an open top end includes a sled capable of moving the container between a first station and a second station spaced from the first station, and a flap-folding assembly movable with the sled. The flap-folding assembly is configured to inwardly fold flaps of the container while the sled moves the container between the first station and the second station. The first station may be a flap-forming station that forms flaps in upright side walls of the container, and the second station may be a lidding station that applies a lid over the inwardly-folded flaps and secures the lid to the container. Alternatively, if the inwardly-folded flaps meet in the middle or overlap and close the open top side, a separate lid is not necessary, and the second station may secure the flaps in the closed, folded configuration, such as with tape, an applied adhesive, heat to activate pre-applied adhesive, staples, stitching, etc., or the second station may provide a shipping label.

The first station may include a flap-forming assembly configured to form flaps from side walls of a container having a bottom wall and upright side walls extending from a periphery of the bottom wall to define an enclosed volume with an upwardly-opening top end. The second station may be a container-closing station and optionally may include a lidding assembly configured to apply a lid to close the container, where the container has an upwardly-opening top end.

A flap-folding assembly for use with a rectangular container having an open side bounded by upwardly-extending flaps, may include (a) a sled that is movable along a path extending in an axial direction, and (b) opposing flap closers coupled to the sled for movement with the sled. The flap closers may be spaced along the path and movable toward each other to inwardly fold flaps of the container.

The flap closers may include axial flap closers and transverse flap closers coupled to the sled for movement with the sled. The transverse flap closers may be spaced apart on opposing transverse sides of the path and movable toward each other to inwardly fold flaps parallel to the axial direction.

The flap closers are vertically adjustable relative to the sled.

Another system for closing a shipping container may include a first station, a second station spaced from the first station, a sled for moving a container from the first station to the second station, and a gluing assembly movable relative to the sled and the container. The gluing assembly may be configured to apply an adhesive to a side wall of a container as the sled moves from the second station to the first station for subsequent attachment of an article to the side wall of the container, and the gluing assembly preferably may be mounted to the sled for movement with the sled.

A method for adjusting a height of an open-topped, generally rectangular shipping container having four upstanding side walls connected at respective corners where adjacent side walls meet, may include the steps of: (a) detecting a height of a tallest item in the shipping container, (b) positioning a cutting blade above the container adjacent a corner and a predetermined distance from one of the side walls, the cutting blade having a cutting edge in a non-horizontal orientation, and (c) moving the cutting blade downward a distance based on the detected height. During the moving step, slicing the side wall with the cutting edge of the cutting blade by engaging the side wall with a sequentially different portion of the cutting edge, wherein the cutting blade moves outwardly in one direction during the slicing step.

The method may further include the step of engaging adjacent side walls at respective corners of the shipping container where adjacent upright side walls of the container meet.

In a system for forming flaps in an open-topped, generally rectangular container having four upstanding side walls connected at respective corners where adjacent side walls meet, where the container is supported by a container support, the system may include (a) a frame supporting a movable structure above the container support that is movable vertically downward relative to the container support, (b) four cutting assemblies connected to the movable structure for movement therewith, each cutting assembly including: (i) a cutting blade support, (ii) a container stabilizer coupled to the cutting blade support that is configured to engage a respective side wall of the container adjacent a respective corner of the container where the respective side wall and an adjacent side wall meet to restrict shifting movement of the container during a cutting operation, and (iii) a cutting blade coupled to the cutting blade support such that when the container stabilizer engages the container the cutting blade is positioned a predetermined distance from the container stabilizer such that as the movable structure moves downward the cutting blade cuts the adjacent side wall.

The container stabilizer may include two container stabilizers disposed at right angles to each other to engage the respective side wall and the adjacent side wall, respectively.

The cutting blade support may be movable relative to the movable structure between an operating position and a reset position outwardly removed from the operating position.

Another system for forming flaps in an open-topped, generally rectangular container having four upstanding side walls may include a frame assembly movable vertically relative to a support for the container, and four fold-forming assemblies connected to the frame assembly and configured to form horizontal fold lines in respective side walls of the container. The fold-forming assemblies may be mounted to the frame assembly so as to be adjustable in respective orthogonal directions to accommodate a range of sizes of containers.

The fold-forming assemblies may be configured to form at least two fold lines simultaneously.

In a method for adjusting a system for forming flaps in an open-topped, generally rectangular shipping container having four upstanding side walls for use with different size containers, the system may include a frame assembly movable vertically relative to a support for the container; and four fold-forming assemblies connected to the frame assembly to form horizontal fold lines in respective side walls of the container. Each of the fold-forming assemblies may include opposing horizontal fold-forming members that are movable toward and away from each other to pinch the side wall therebetween to form a horizontal fold line that facilitates folding an upper portion of the side wall above the fold line relative to a lower portion of the side wall below the fold line from an upright orientation to a horizontal orientation. The method may include the steps of: (a) moving at least two of the fold-forming assemblies on the frame assembly in a direction toward or away from each other to accommodate a different size shipping container, and (b) replacing opposing fold-forming members of two fold-forming assemblies to provide fold-forming members that extend a width of the side wall of the container in which a fold line is to be formed.

The system may include a sensor for detecting a height of a tallest item in the shipping container, and the sensor may include a pressure plate supported horizontally by the frame assembly that is configured to be received within the shipping container. Accordingly, the method may further include the step of replacing the pressure plate with a pressure plate configured to be received within a different size shipping container.

In another method for adjusting a system for forming flaps in an open-topped, generally rectangular shipping container having four upstanding side walls for use with different size containers, the system may include a frame assembly movable vertically relative to a support for the container; and four flap-forming assemblies connected to the frame assembly to cut side walls of the container adjacent respective corners to form flaps. Each of the flap-cutting assemblies may include container stabilizers for engaging respective side walls of the container and cutting blades positionable to vertically cut side walls of the container a predetermined distance from adjacent side walls of the container as the frame assembly moves downward. The method may include the steps of: (a) moving the cutting blade from a reset position spaced from the container to a cutting position where the cutting blade is positioned directly above a side wall of the container, and (b) adjusting the cutting position to accommodate a different size shipping container.

In a system for forming flaps in an open-topped container having a rectangular bottom wall and four upstanding side walls extending from the perimeter of the bottom wall and forming corners where adjacent side walls meet, with the container being supported by a support, the flap-forming system may include (a) a frame supporting a movable structure that is movable vertically relative to the support for the container, (b) a sensor coupled to the frame for detecting a height of a tallest object inside a container on the support, (c) four cutting assemblies connected to the movable structure for movement therewith to make vertical cuts in the side walls adjacent each corner of the container to a depth determined as a function of the detected height of the tallest object in the container, and (d) four fold-forming assemblies connected to the movable structure for movement therewith to form horizontal fold lines in respective side walls of the container at a common height determined as a function of the detected height of the tallest object in the container.

The frame may include a motor to move the movable structure. The motor may include a servo motor and a coder coupled to a controller that is configured to determine a height of the tallest object in the container based on data from the coder. The system may include a controller in communication with the motor and the sensor that stops the motor from moving the support structure further downward after receiving the signal from the sensor.

The sensor may include a rectangular plate hanging beneath the movable structure that is smaller than the bottom wall of the container for receipt inside the container and an indicator configured to output a signal when the rectangular plate contacts the tallest object in the container.

The cutting assemblies and fold-forming assemblies may be interspersed within a common horizontal cross-sectional area, and the sensor also may be located within that area.

The system may include a controller in communication with the sensor to control movement of the movable structure in response to the detected height.

The cutting assemblies may include two cutting blades in each of two parallel planes, the planes being spaced apart a distance less than a width of the container.

The cutting blade may have a cutting edge that is inclined relative to horizontal and vertical directions.

Another method for closing an open-topped, generally rectangular shipping container having four upstanding side walls connected at respective corners where adjacent side walls meet, may include the steps of moving a container between a first station and a second station while inwardly folding one or more flaps of the container.

The moving step may include moving the first container from the first station to the second station, and simultaneously moving a second container to the first station.

The folding step may include adjusting a height of flap-folders based on a predetermined height of a tallest item in the container.

The method may further include the step of applying adhesive to a container adjacent a fold line as the sled moves axially into position adjacent the container.

The folding step may include folding at least two flaps sequentially.

The folding step may include folding opposing flaps on transverse sides sequentially.

Another method for closing an open-topped, generally rectangular shipping container having four upstanding side walls connected at respective corners where adjacent side walls meet, may include the steps of: (a) moving a support structure vertically relative to the container, (b) detecting a height of a tallest object inside the container, (c) vertically cutting the side walls adjacent each corner of the container simultaneously to a depth determined as a function of the detected height of the tallest object in the container, (d) forming horizontal fold lines in respective side walls of the container at a common height determined as a function of the detected height of the tallest object in the container, (e) folding flaps formed by the vertical cutting and forming steps inwardly from an upright orientation toward a horizontal orientation while moving the container to a lidding station, and (f) applying a lid to a top side of the container over the inwardly-folded flaps and securing the lid to the container.

The applying step may include providing a lid that has tabs extending in orthogonal directions, and the securing step includes folding the tabs downward over the fold lines of the container and securing the tabs to respective side walls of the container.

The method may further include the step of applying an adhesive to at least two tabs of the lid as the lid is moved from a magazine to the container.

A method for sizing a shipping container relative to a height of a tallest item in the shipping container, may include the following steps: (a) detecting a height of the tallest item in the shipping container, (b) positioning a cutting blade parallel to and a predetermined distance from one of the detected side walls, and (c) moving the cutting blade downward a distance based on the detected height.

The cutting blade has a cutting edge and during the cutting step, the method may further include the step of moving the cutting blade in a direction parallel to the cutting edge.

The cutting blade has a cutting edge and the method may further include the step of supporting the cutting blade such that the cutting edge is nonparallel to the side wall of the shipping container being cut.

During the cutting step, the method may further include the step of withdrawing the cutting blade in a direction away from an interior volume of the container bounded by the upright side walls as the cutting blade engages and slices a side wall during the withdrawing step.

After the cutting step, the method may further include the step of forming horizontal fold lines in the side walls of the container at a common height on all four sides of the container.

These and other features of the present invention are described in detail in the following description and accompanying drawings.

DETAILED DESCRIPTION

Figure 1:
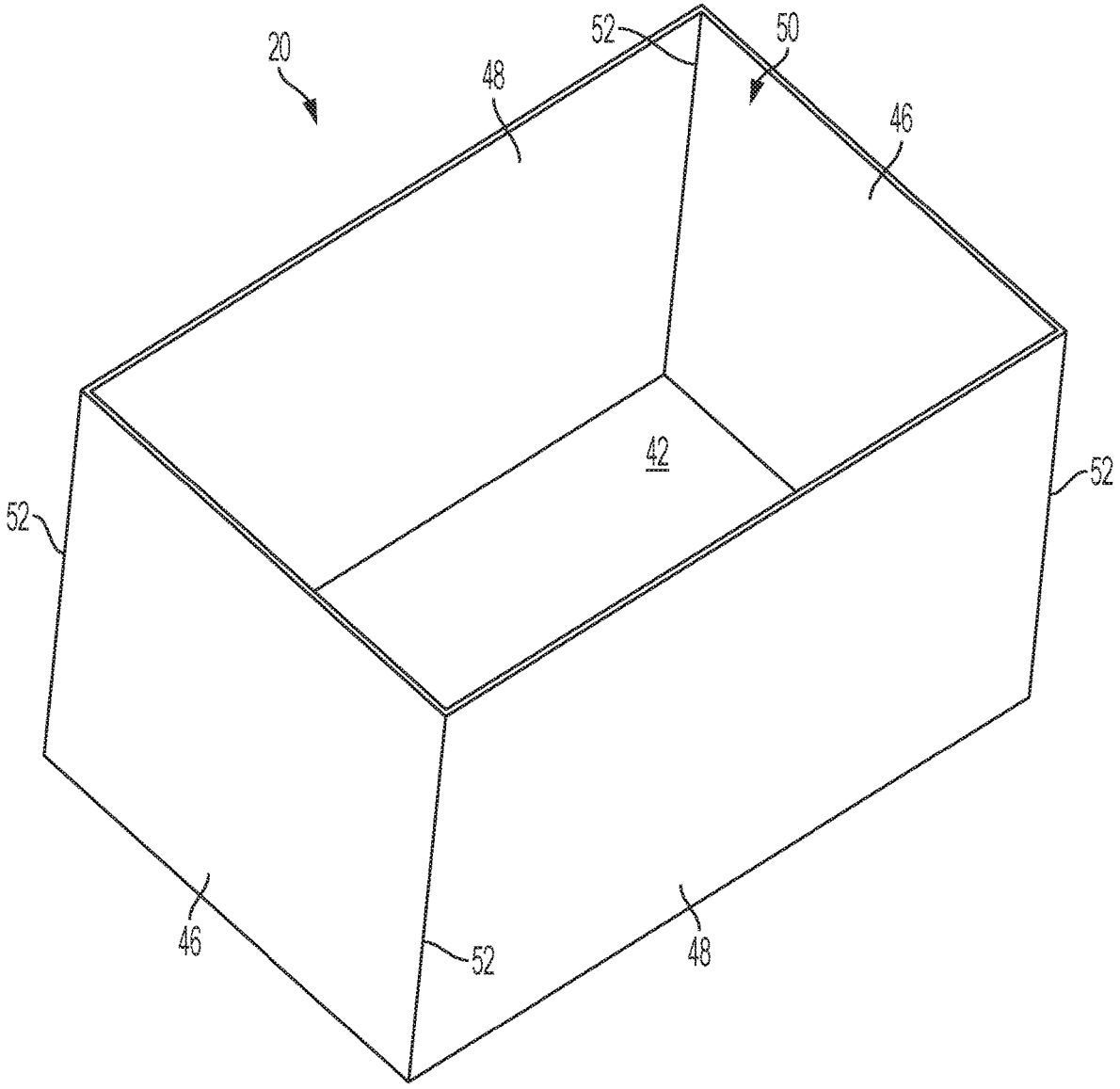
FIG. 1 PRIOR ART
FIG. 1 is a perspective view of a known shipping container.
Figure 2:
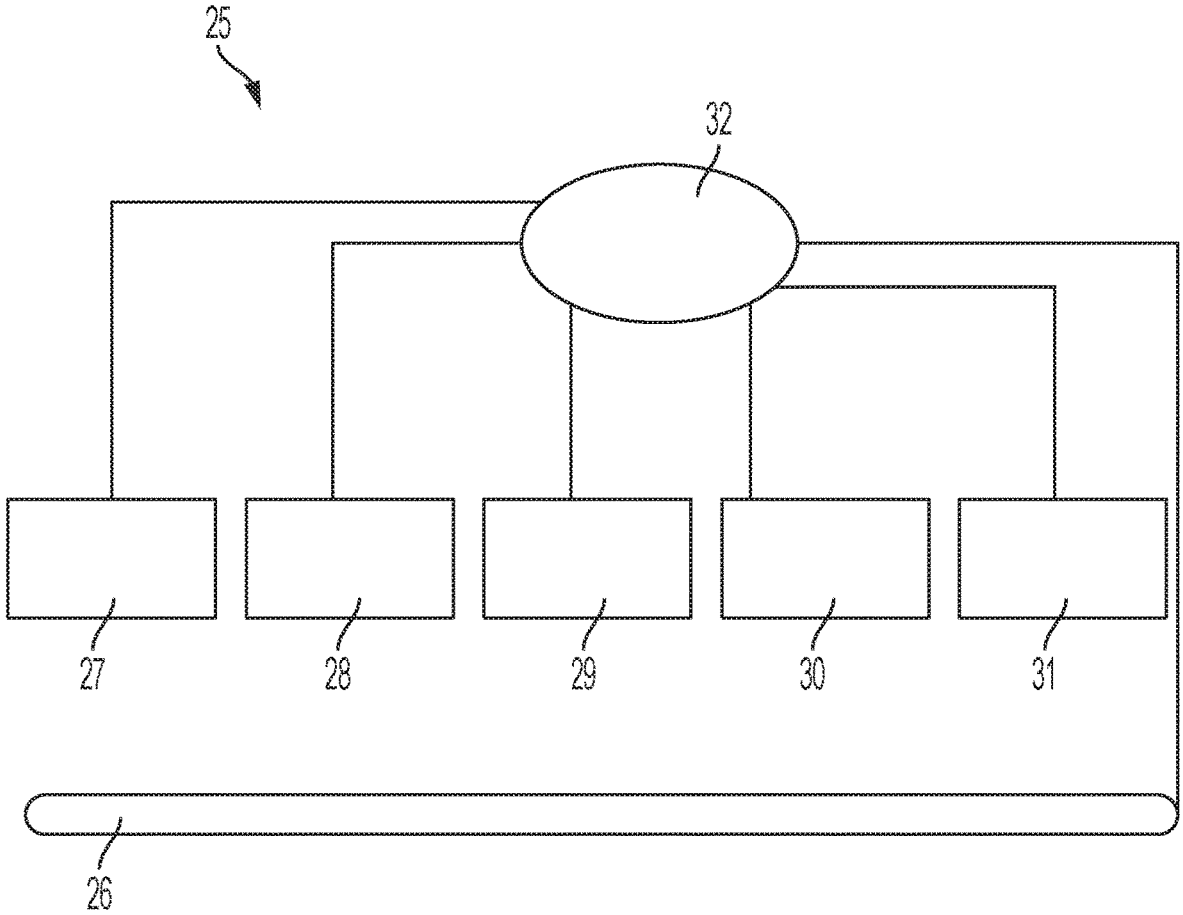
FIG. 2 PRIOR ART
FIG. 2 is a schematic illustration of a prior art container closing system.

With reference to these drawings, an exemplary system 40 provided in accordance with the present invention is shown schematically in FIG. 4, and an exemplary embodiment will be described with reference to the remaining drawings. This is an automatic container closing system 40 that forms optimal-height boxes from rectangular containers 20, quickly and efficiently. The terms "container" and "box" mean the same thing in this context. As seen in FIG. 1, the containers 20 typically have a rectangular bottom wall 42 and upright side walls 46 and 48 bounding the periphery of the bottom wall 42, with an open end at the top 50. The side walls 46 and 48 intersect at respective corners 52. Exemplary containers 20 and lid blanks 33 are made of cardboard, particularly paper corrugated cardboard, which is recyclable, reusable, and composed primarily of a renewable resource.

Figure 4:
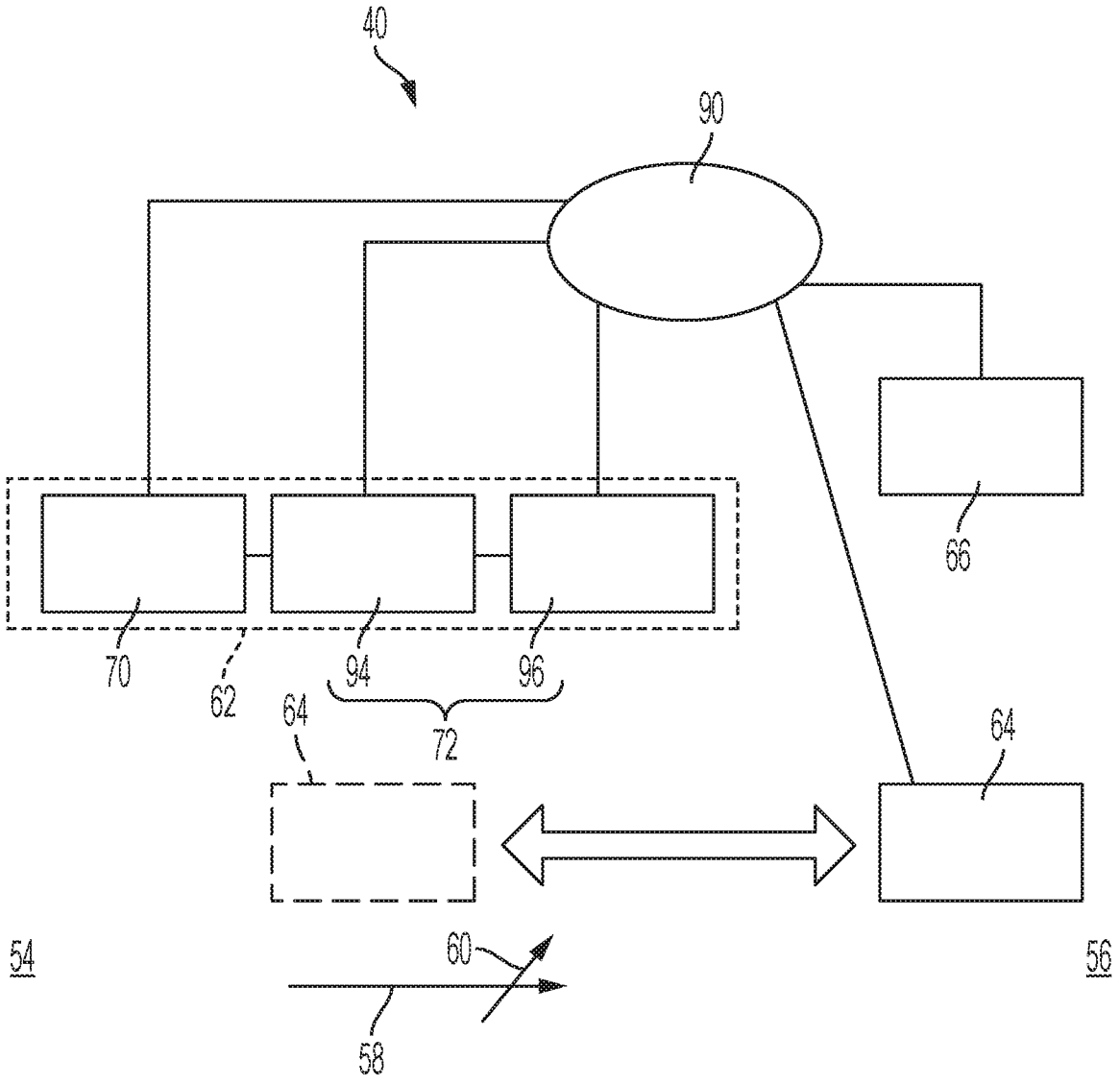
FIG. 4 is a schematic illustration of an automatic container closing system provided by the present invention.
Figure 5:
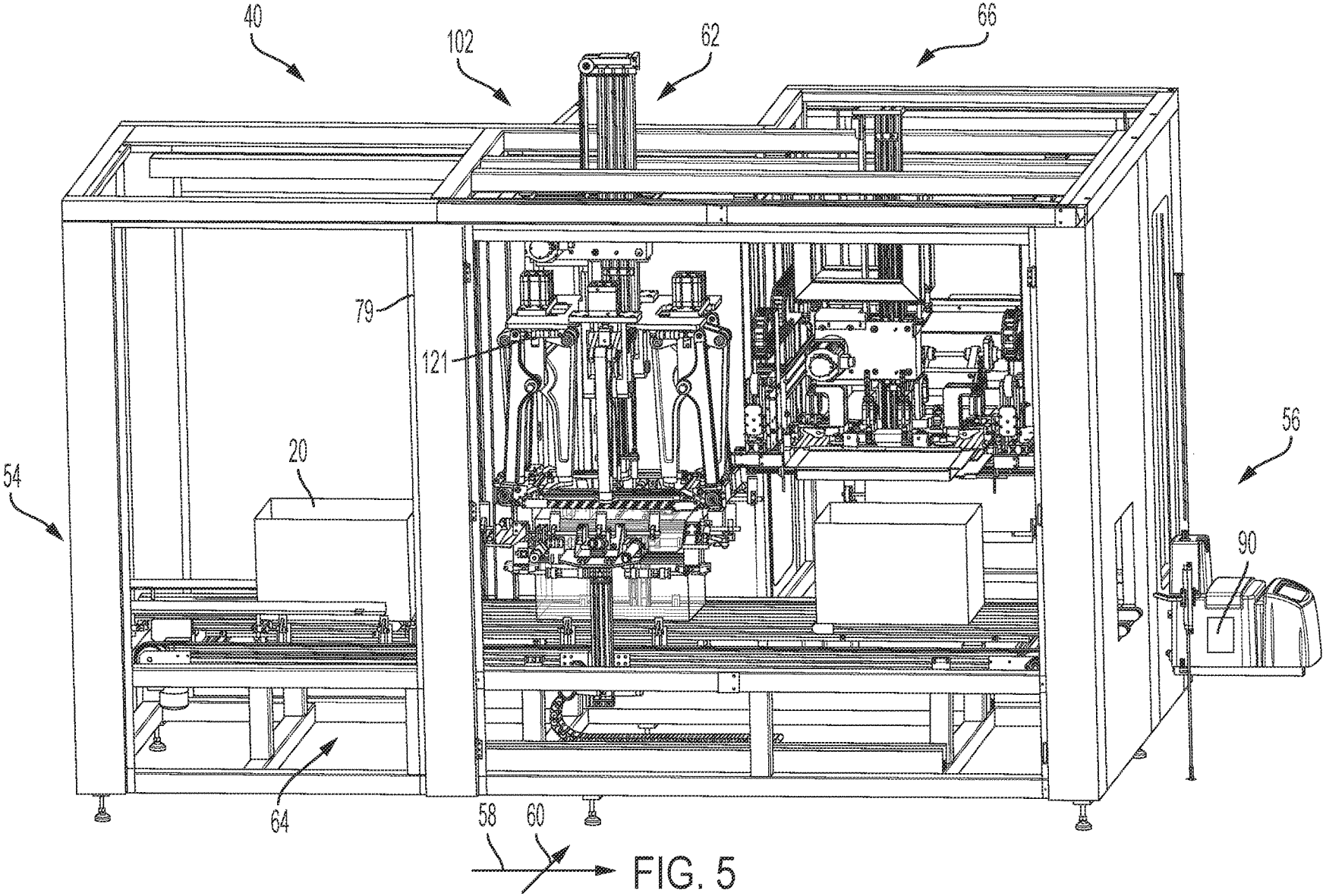
FIG. 5 is a perspective view of an exemplary automatic closing system provided by the present invention with a flap-closing assembly in a first position adjacent a flap-forming station and a frame assembly removed to more clearly show the flap-forming station and a lidding station.
Figure 6:
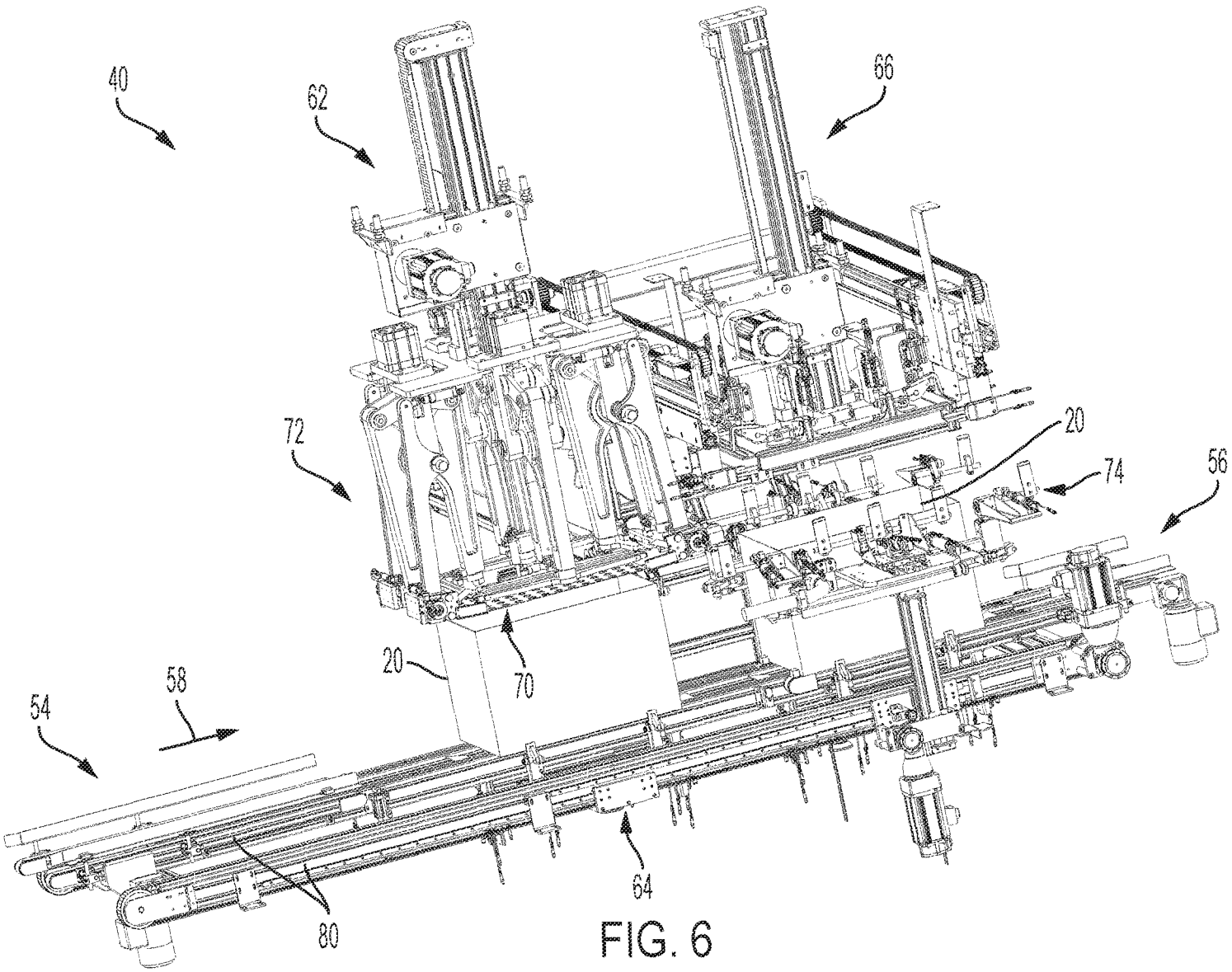
FIG. 6 is a perspective view of the automatic closing system of FIG. 5 with the flap-closing assembly in a second position adjacent a lidding station.
Figure 7:
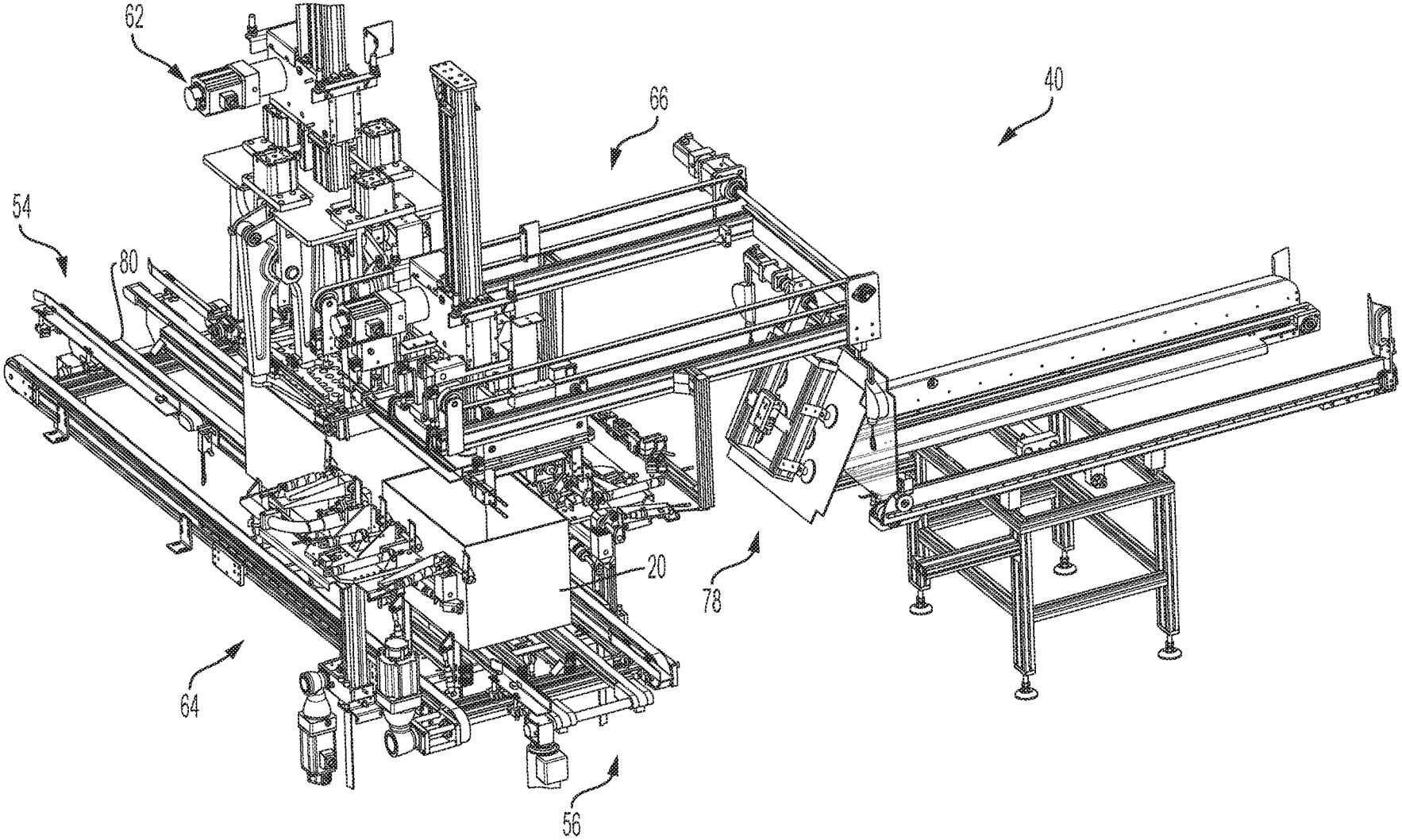
FIG. 7 is another perspective view of the automatic closing system of FIG. 6.
Figure 8:
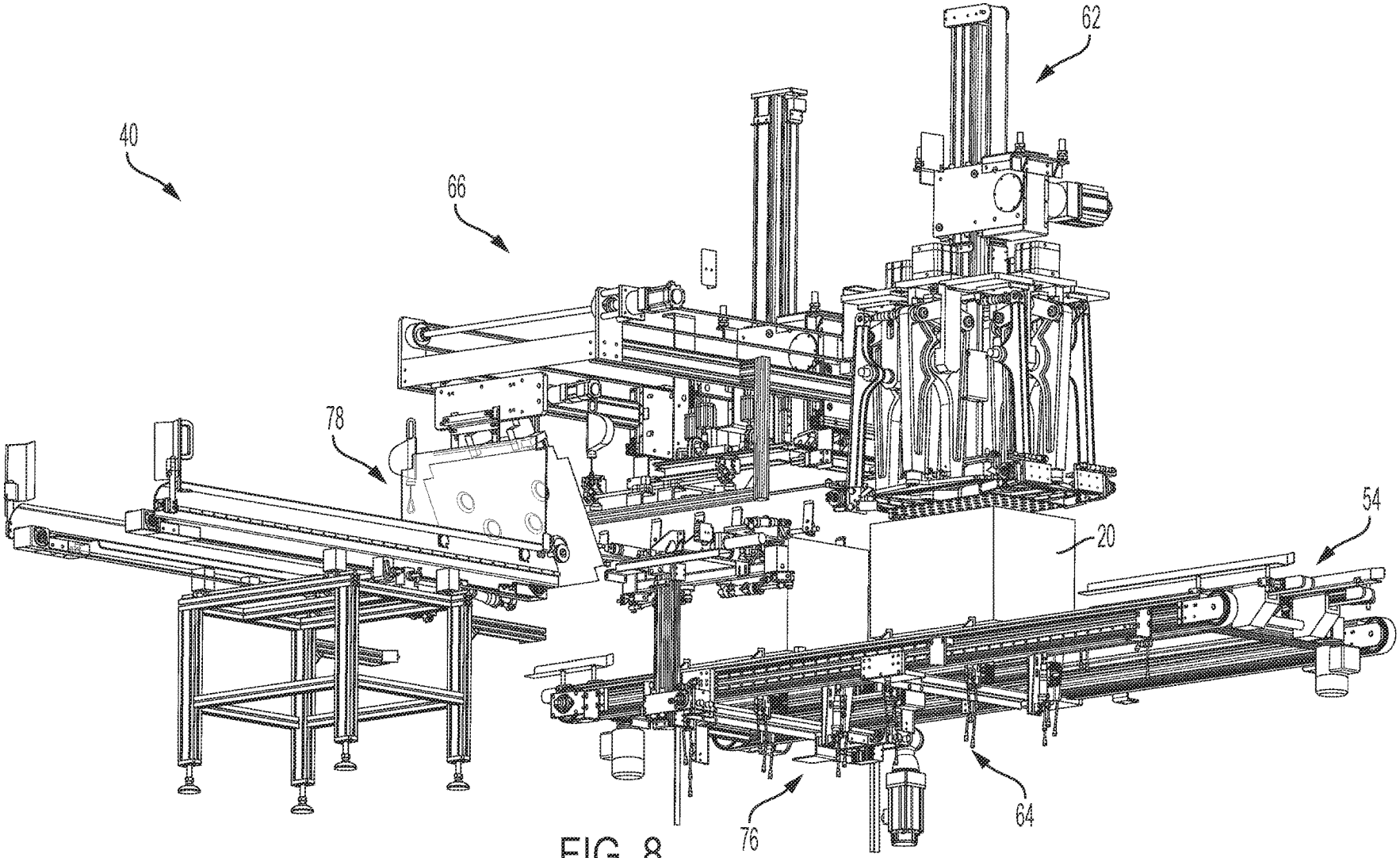
FIG. 8 is another perspective view of the automatic closing system of FIG. 6.

Referring now to FIGS. 4 and 5, containers 20 move through the system 40 from an upstream end 54 toward a downstream end 56 in a downstream direction 58. An upstream direction is opposite the downstream direction. That downstream direction 58 also may be referred to as an axial direction, and a transverse direction 60 is perpendicular to the axial direction in a horizontal plane. Thus, the containers 20 moving through the system 40 have opposing axial side walls 46 perpendicular to the axial direction 58 and opposing transverse side walls 48 parallel to the axial direction 58.

The illustrated system 40 shown in FIGS. 4 to 8 includes a flap-forming station 62, a flap-folding station 64, and a lidding station 66. The flap-folding station 64 moves containers 20 from the flap-forming station 62 to the lidding station 66. The flap-forming station 62 includes a sensor 70 that detects a height of contents in the container 20, and a flap-forming assembly 72 that cuts opposing side walls 46 or 48 of the container 20 vertically near the corners 52 and creases all four side walls 46 and 48 to form horizontal fold lines at a distal end of the cuts in the side walls based on information provided by the sensor 70. The flap-folding station 64 includes a flap-folding assembly 74 that inwardly folds the flaps above the fold lines. The flap-folding assembly 74 may be mounted to a sled 76 that conveys containers 20 from the flap-forming station 62 to the lidding station 66, with the flap-forming assembly 74 inwardly folding the flaps as the sled 76 moves the container 20. The lidding station 66 seals the container 20 closed, and may include a lidding assembly 78 that caps the box 20 over the inwardly-folded flaps to ensure that the contents are sealed in the box. In some situations, for example when the flaps sufficiently close the open end of the container 20, where the flaps may attach to each other such as with a pre-applied cohesive material, a separate lid and no further closing operations are needed. In that case, the lidding assembly 78 may be omitted. In the absence of the lidding assembly 78, the flap-folding station 64 may move the container 20 from the flap-forming station 62 to the lidding station 66 for a different operation, such as application of a label, or directly to a position at the downstream end 56 of the system 40.

The container closing system 40 also may include a frame or frame assembly 79 to support components of the system 40, which includes a container support 80 to support the container 20, typically from below, as the container 20 moves through the system 40.

The system 40 also includes a controller 90 in communication with the flap-forming station 62, the flap-folding station 64, and, if present, the lidding station 66.

Controller

The controller 90 is configured to control the various components of the system 40, and may include a processor, a memory, and programming instructions that enable the controller 90 to perform its functions. The controller 90 is in communication with each of the stations 62, 64, and 66 of the system 40, and may be a single unit or may be distributed across multiple units, such as discrete controllers associated with one or more respective components of the system 40.

Flap-Forming Station—Sensor

Figure 9:
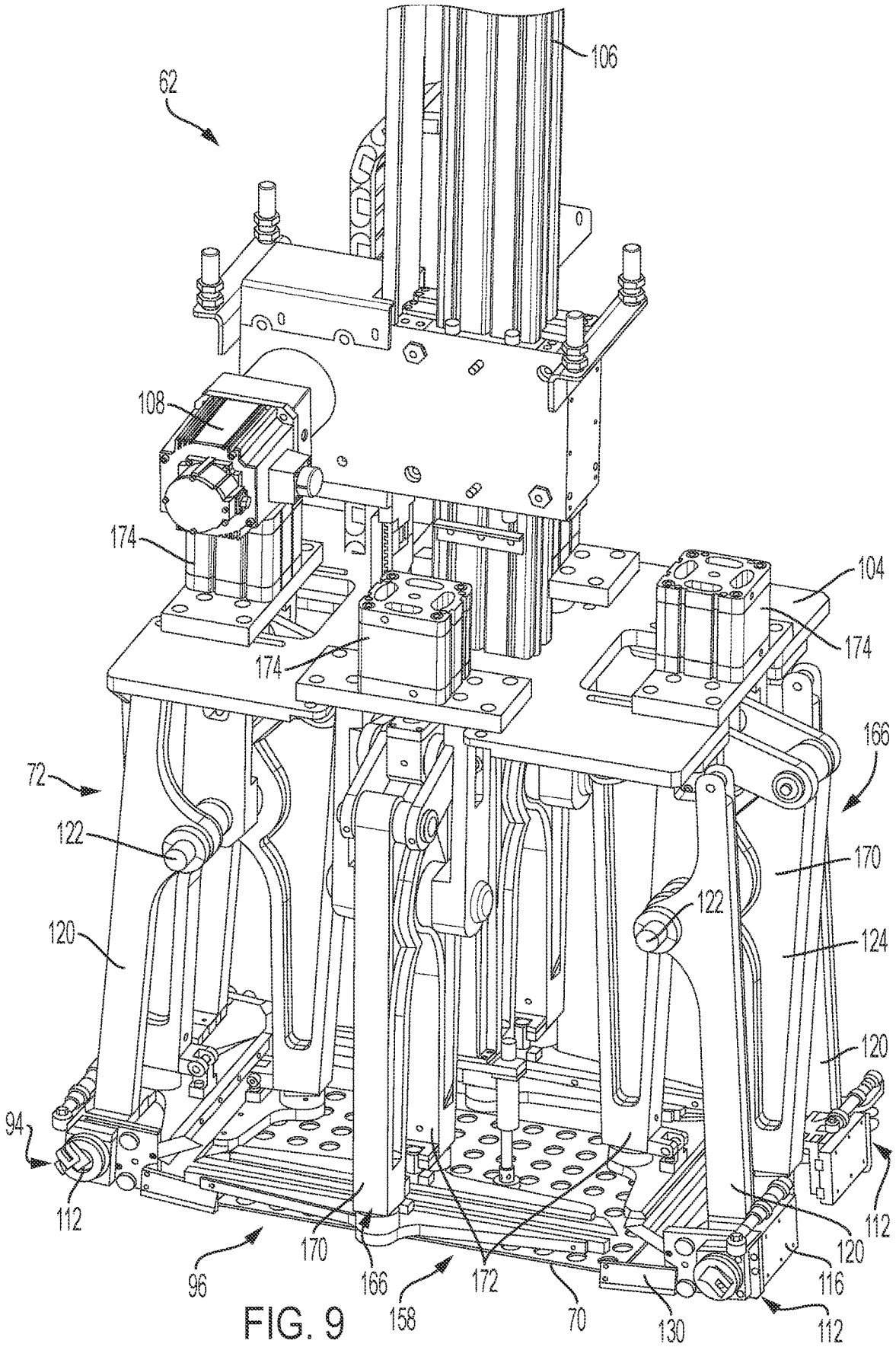
FIG. 9 is an enlarged perspective view of a flap-forming assembly of the automatic closing system of FIG. 5.
Figure 10:
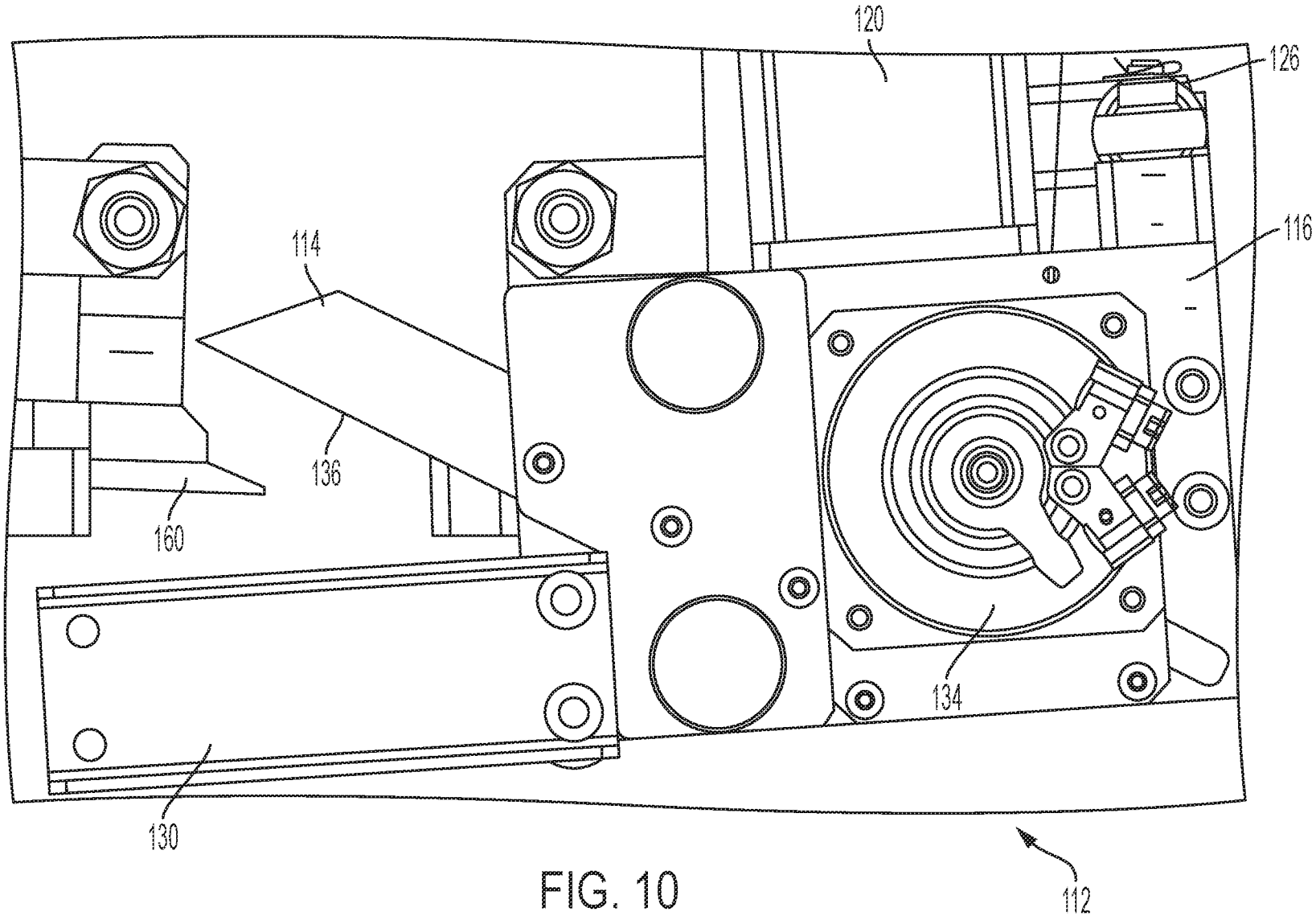
FIG. 10 is an enlarged elevation view of a cutting blade housing of the flap-closing assembly of FIG. 9.
Figure 11:
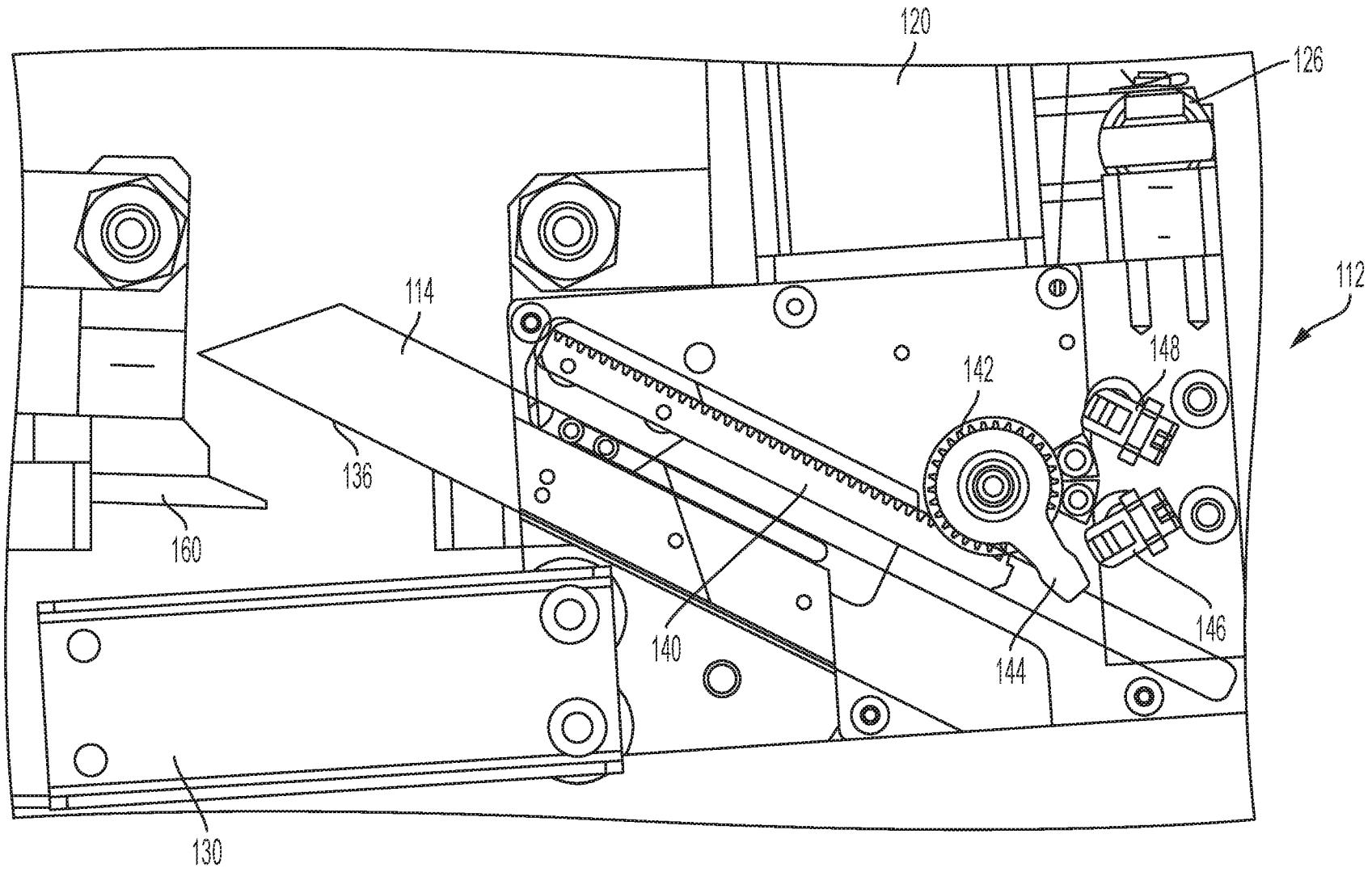
FIG. 11 is an elevation view of the cutting blade housing of FIG. 10, with portions of the housing rendered transparent to show internal components.
Figure 12:
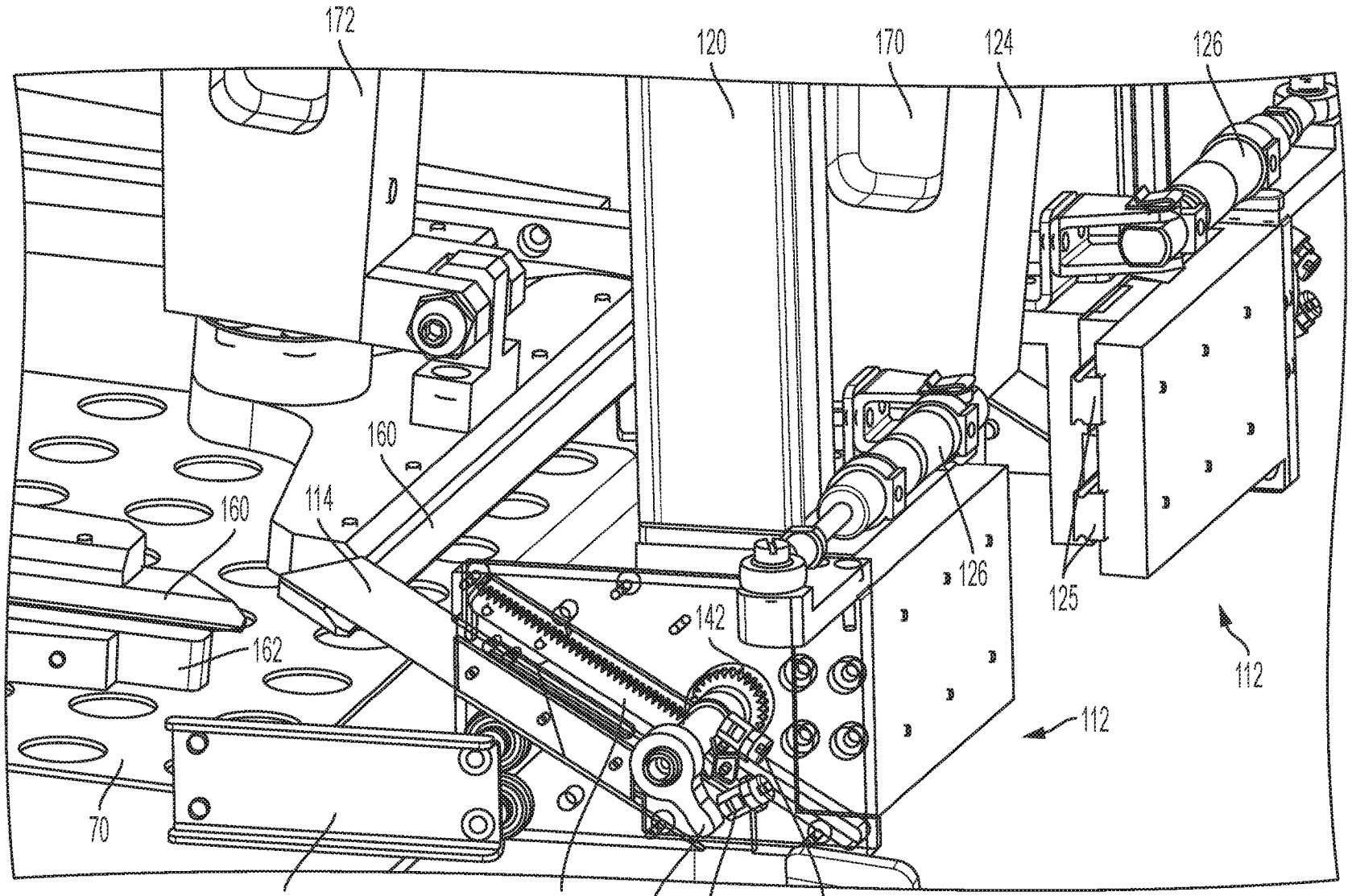
FIG. 12 is a perspective view of the cutting blade housing of FIG. 11.
Figure 13:
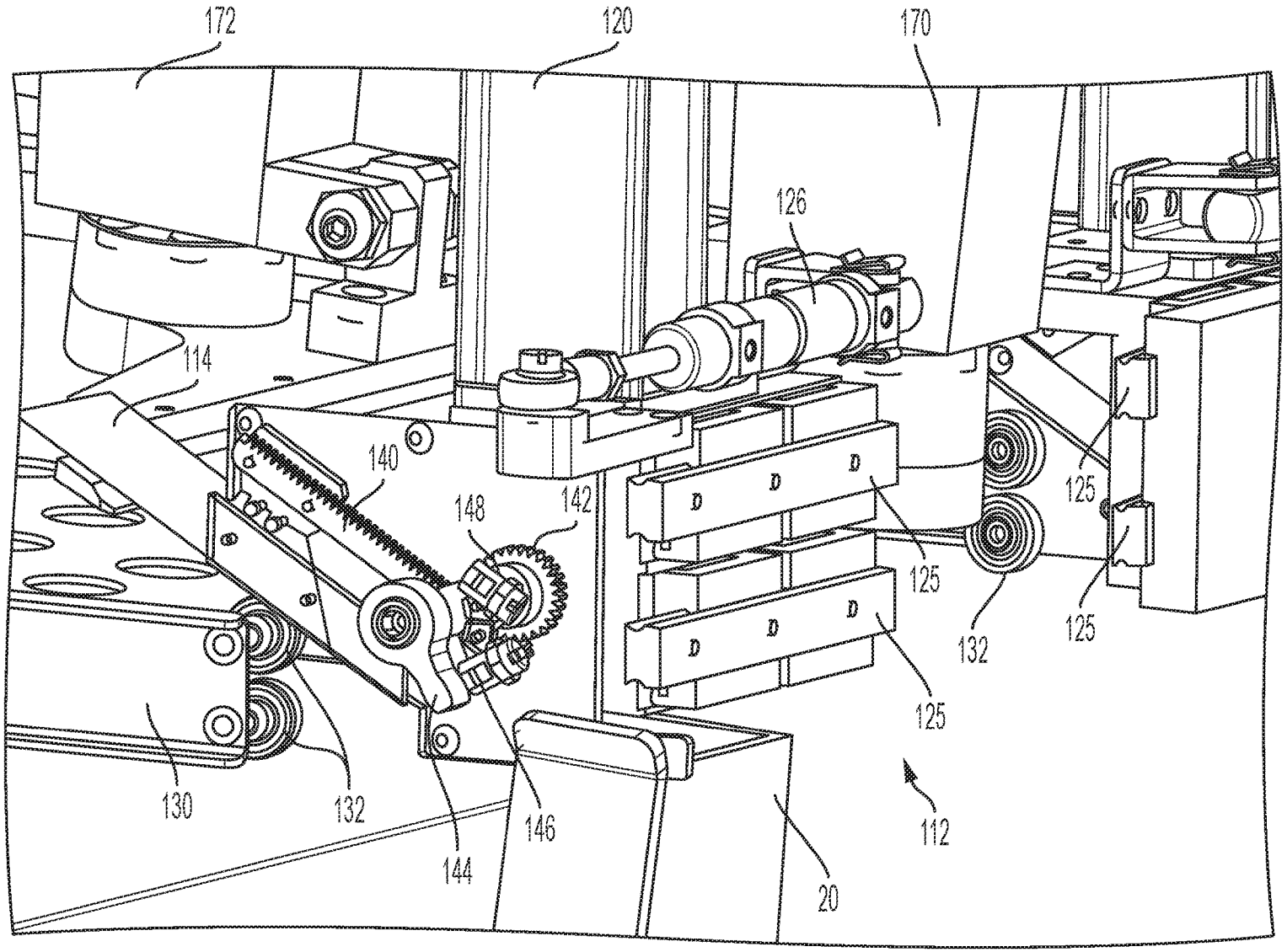
FIG. 13 is another perspective view of the cutting blade housing of FIG. 11 with portions of the housing removed to show internal components.
Figure 14:
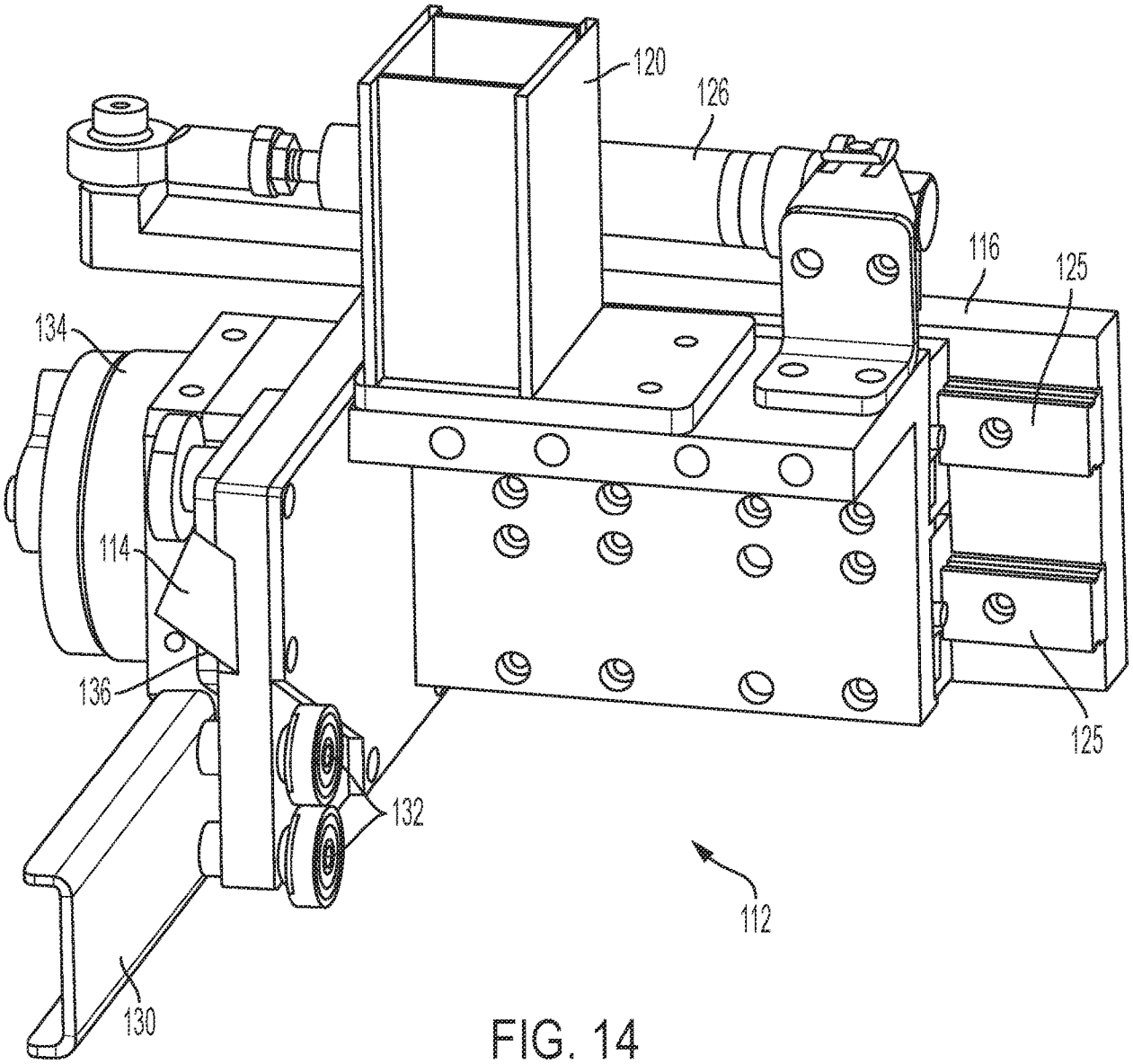
FIG. 14 is a perspective view of the cutting blade housing of FIG. 10 as seen from the container.
Figure 15:
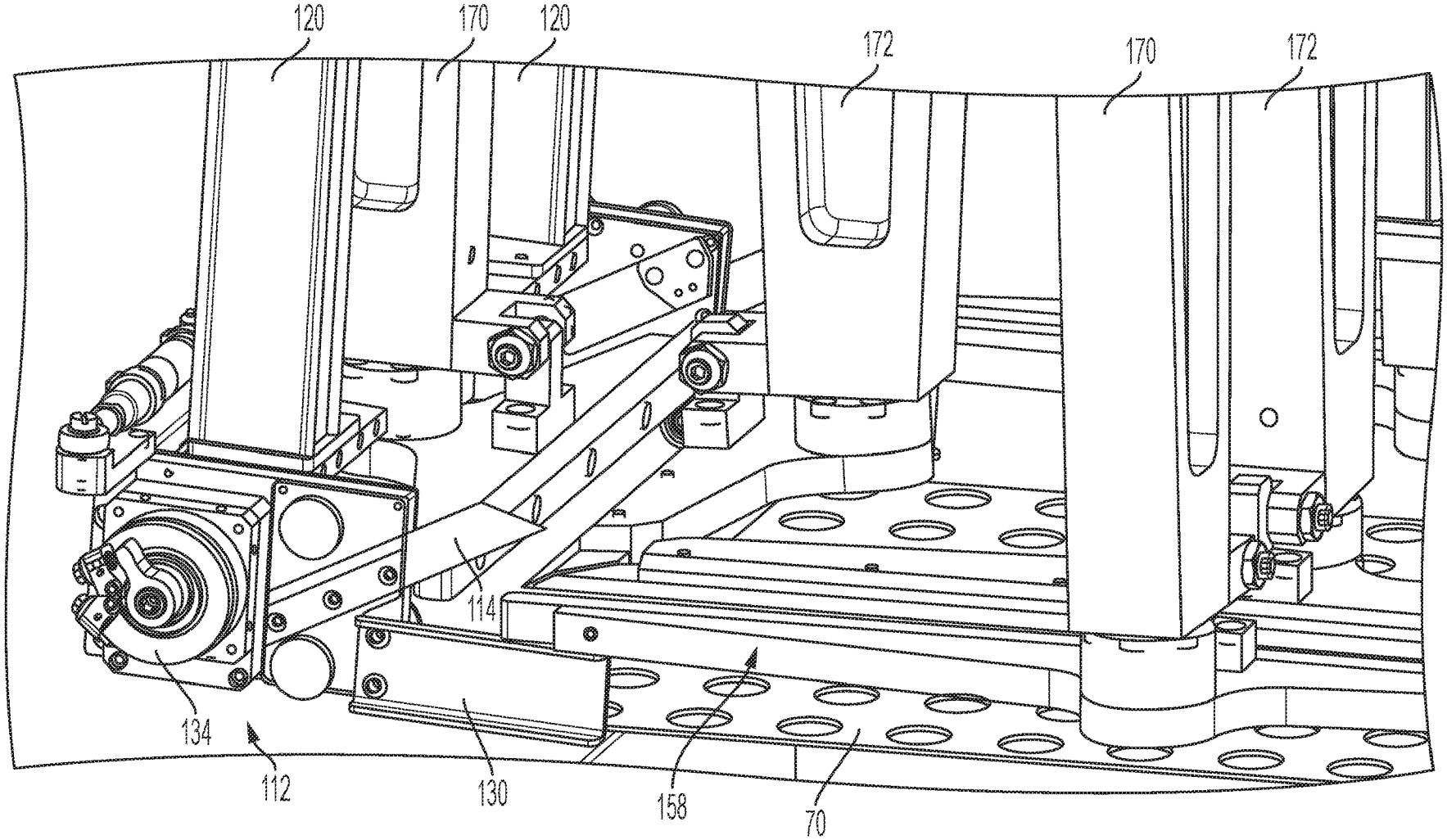
FIG. 15 is another enlarged perspective view of a flap-forming assembly of the automatic closing system of FIG. 6.
Figure 16:
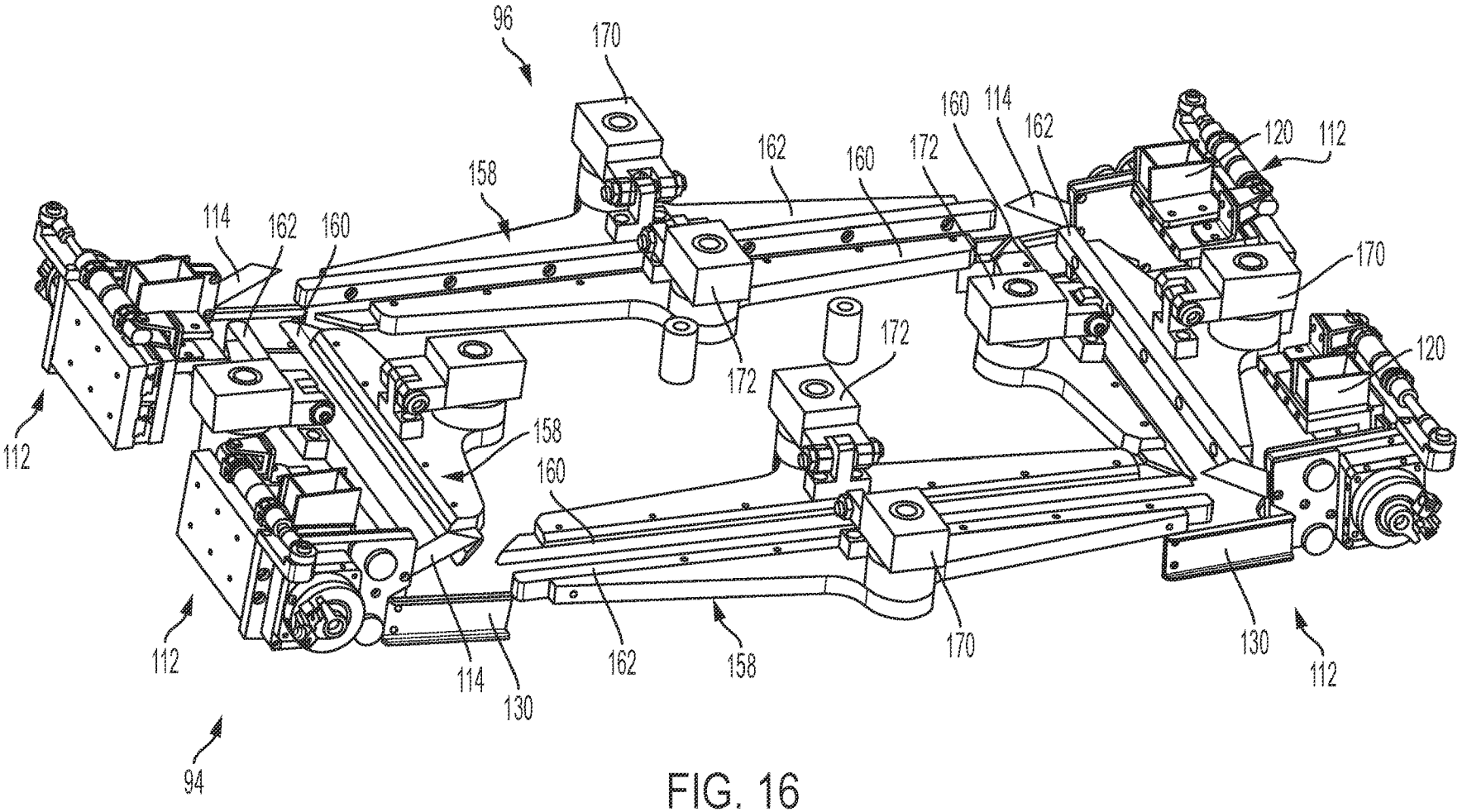
FIG. 16 is an enlarged, perspective cross-sectional view of portions of the flap-cutting and fold-line-forming assemblies of the flap-forming assembly of FIG. 9.
Figure 17:
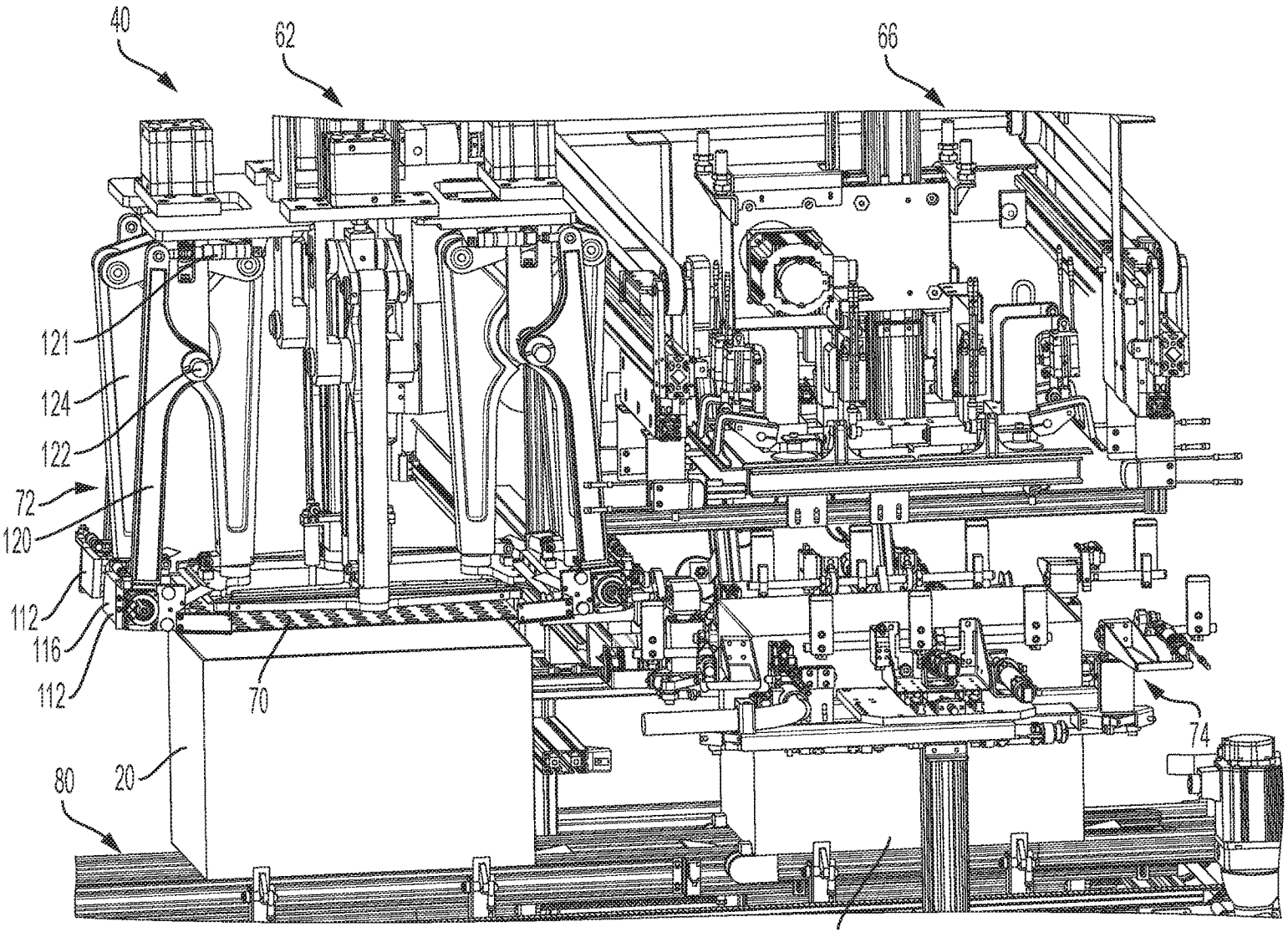
FIG. 17 is another enlarged front perspective view of the automatic closing system of FIG. 6.
Figure 18:
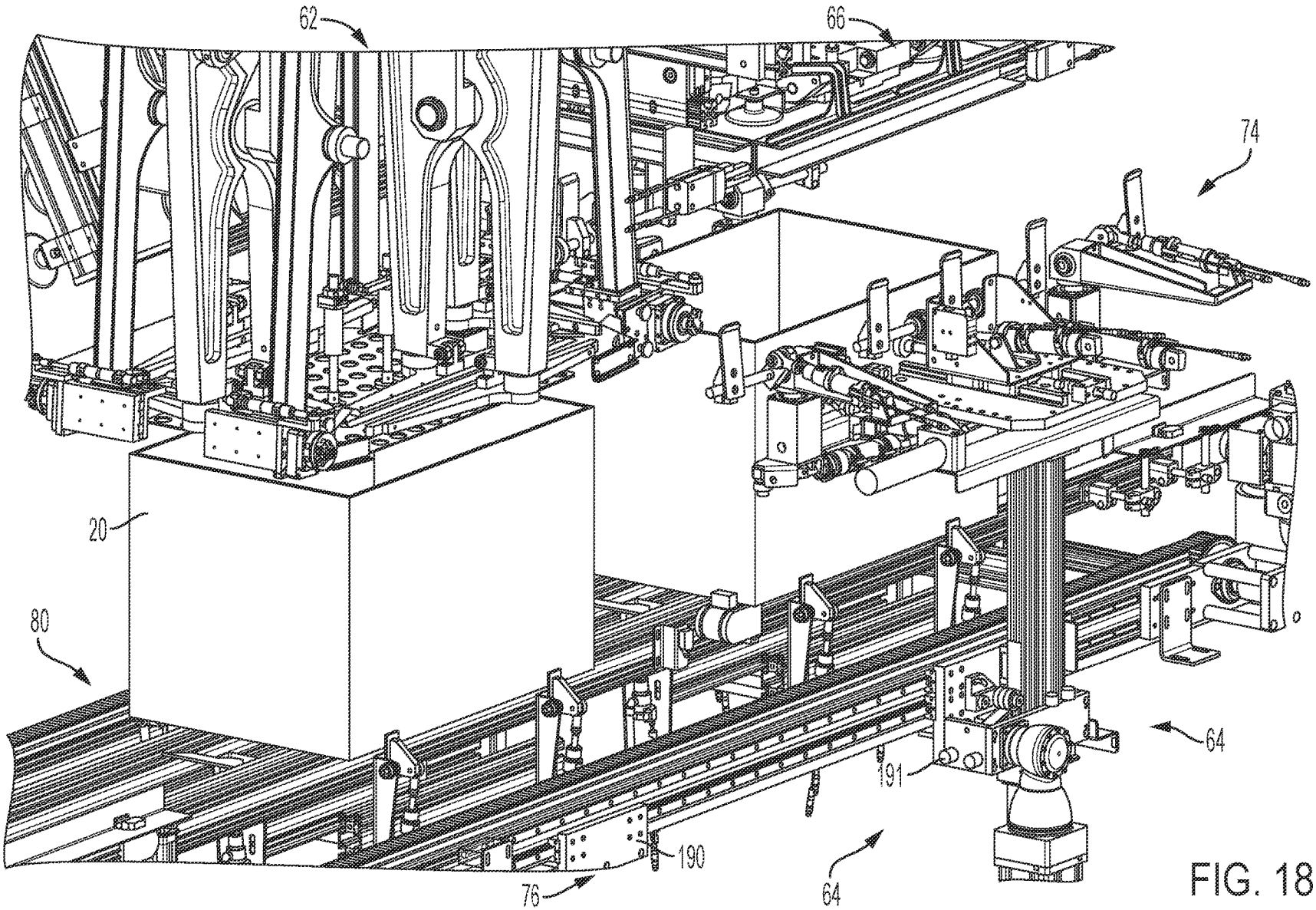
FIG. 18 is another perspective view of the automatic closing system of FIG. 17.
Figure 19:
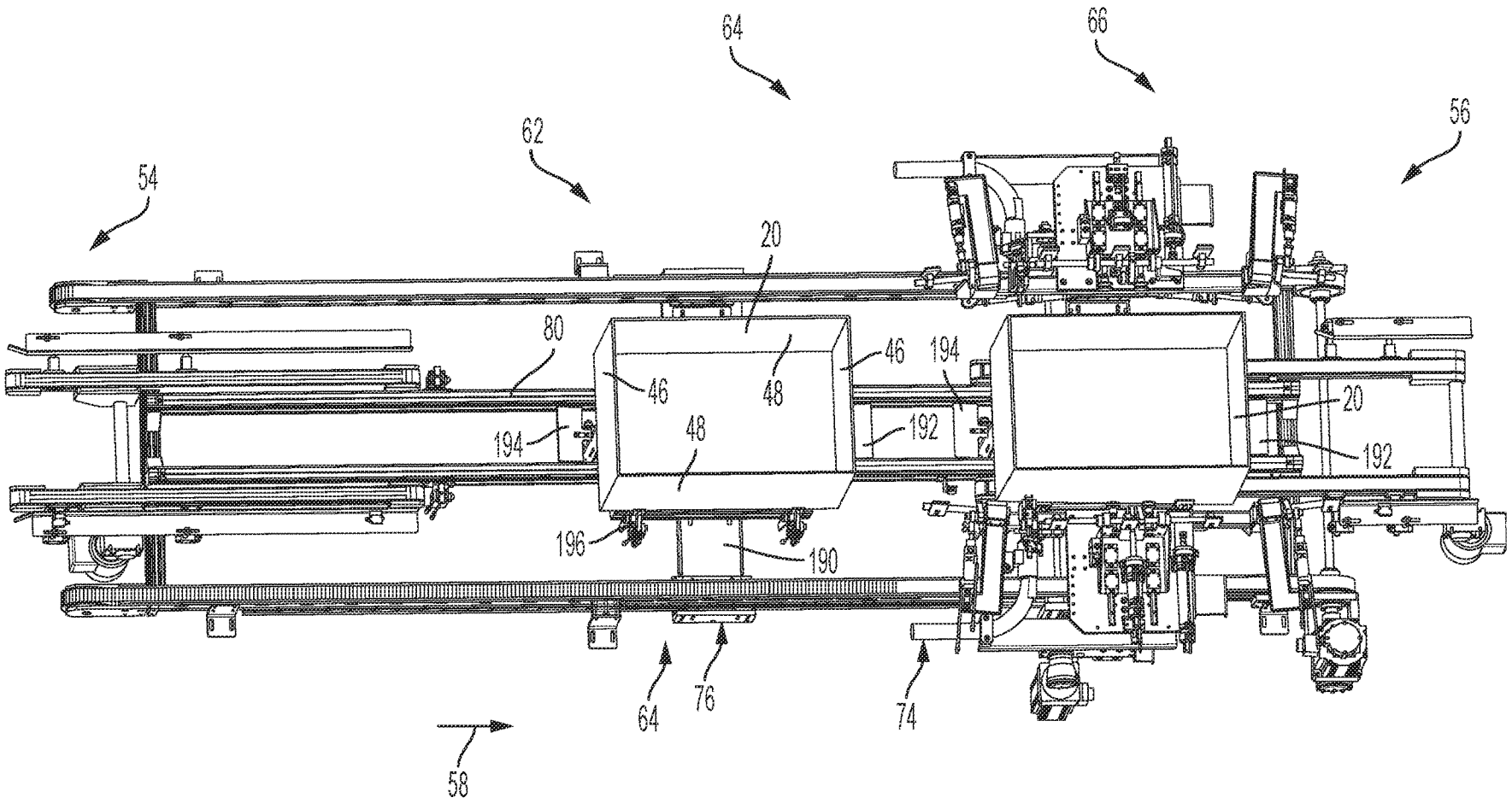
FIG. 19 is an overhead perspective view of a flap-folding station isolated from the automatic closing system of FIG. 6.
Figure 20:
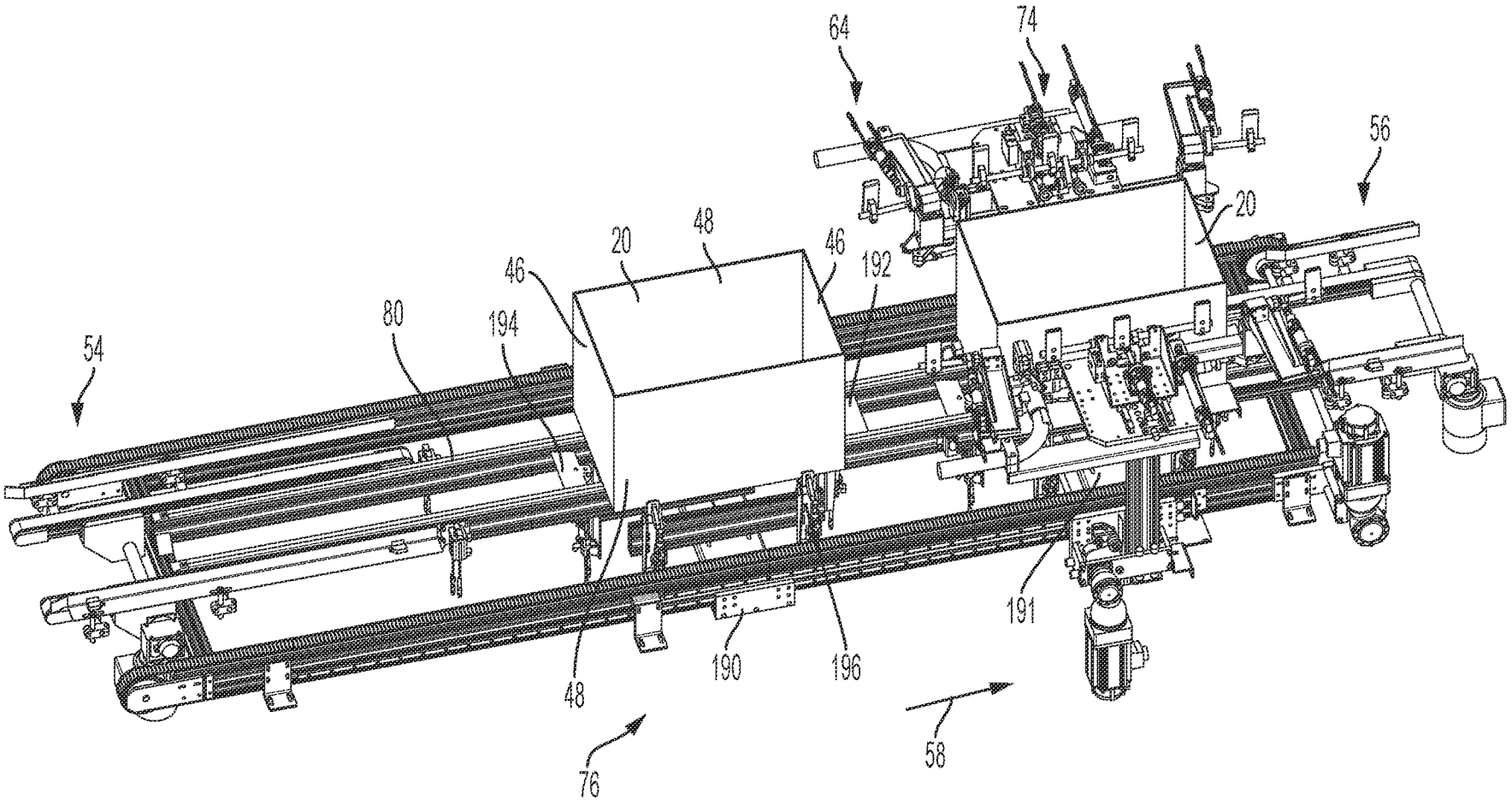
FIG. 20 is a front perspective view of the flap-folding station of FIG. 19.
Figure 21:
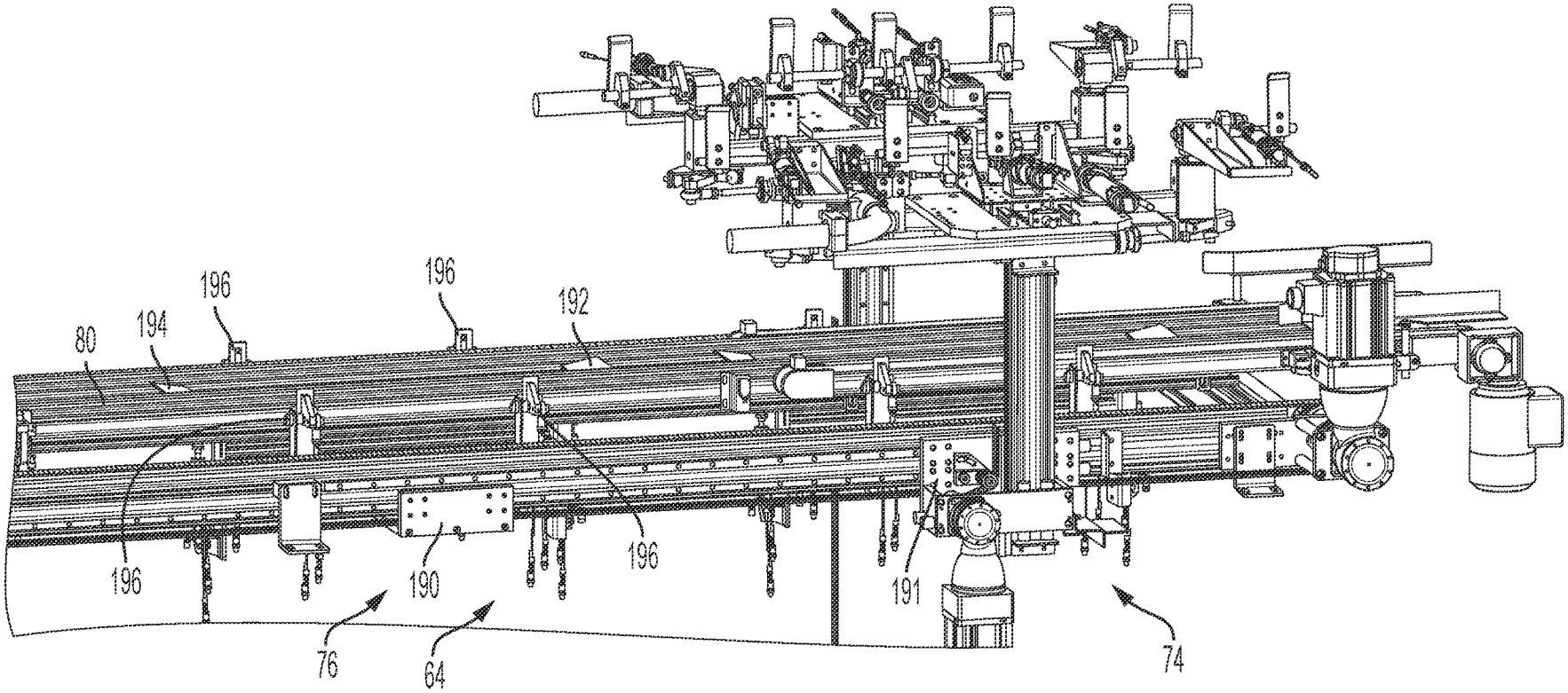
FIG. 21 is an enlarged perspective view of the flap-folding station of FIG. 20.
Figure 22:
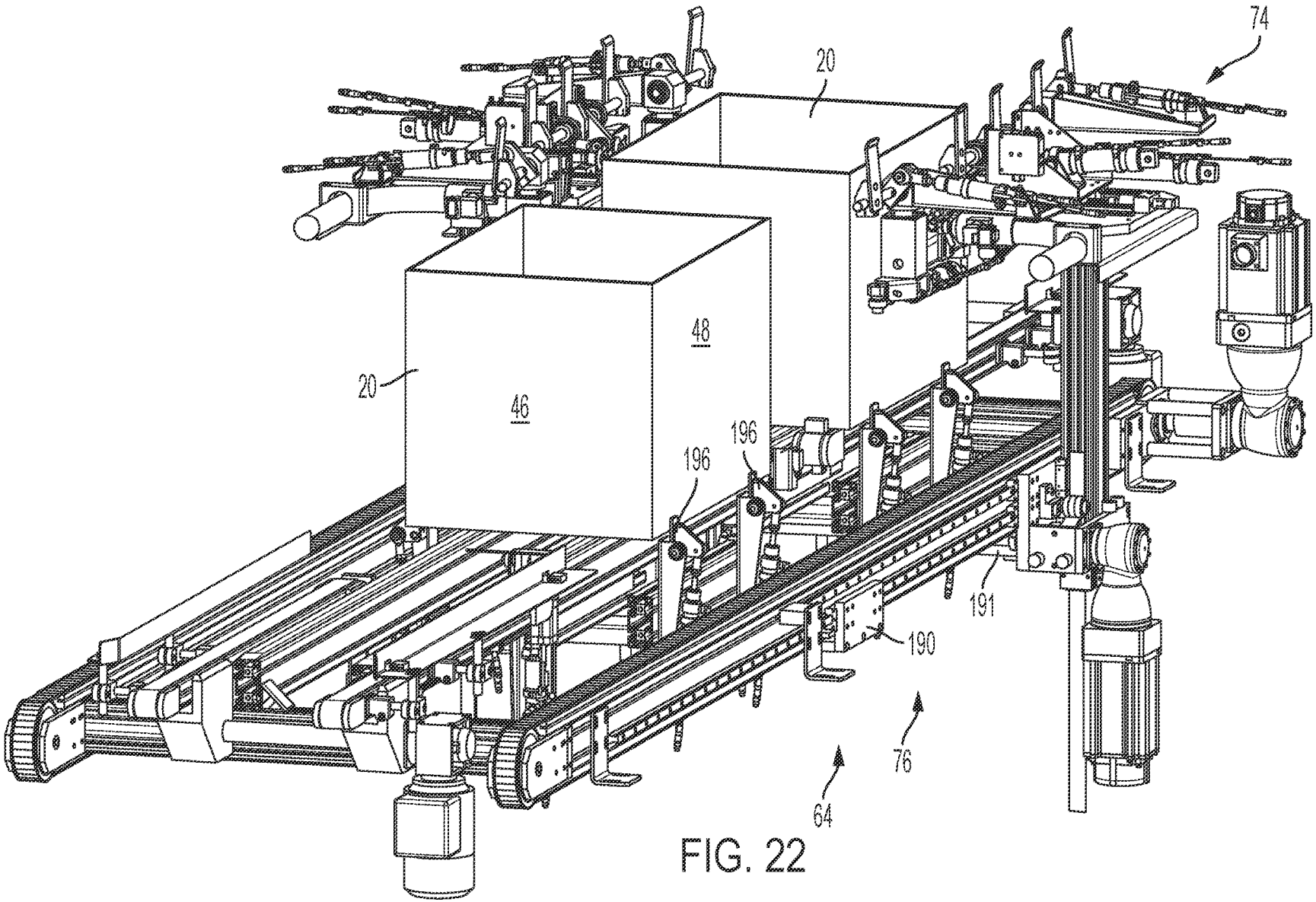
FIG. 22 is another perspective view of the flap-folding station of FIG. 19.
Figure 23:
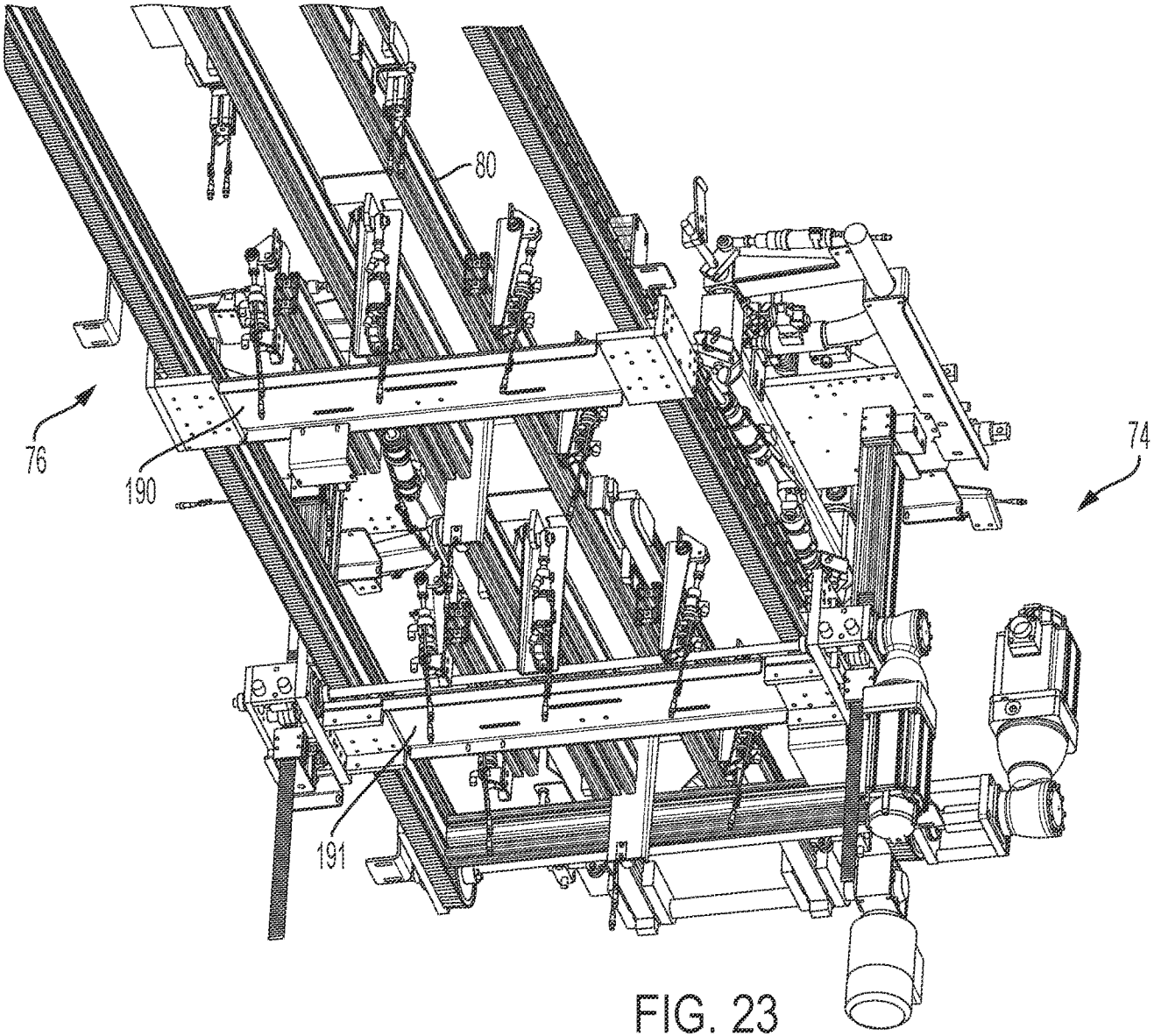
FIG. 23 is a bottom perspective view of the flap-folding station of FIG. 19.
Figure 24:
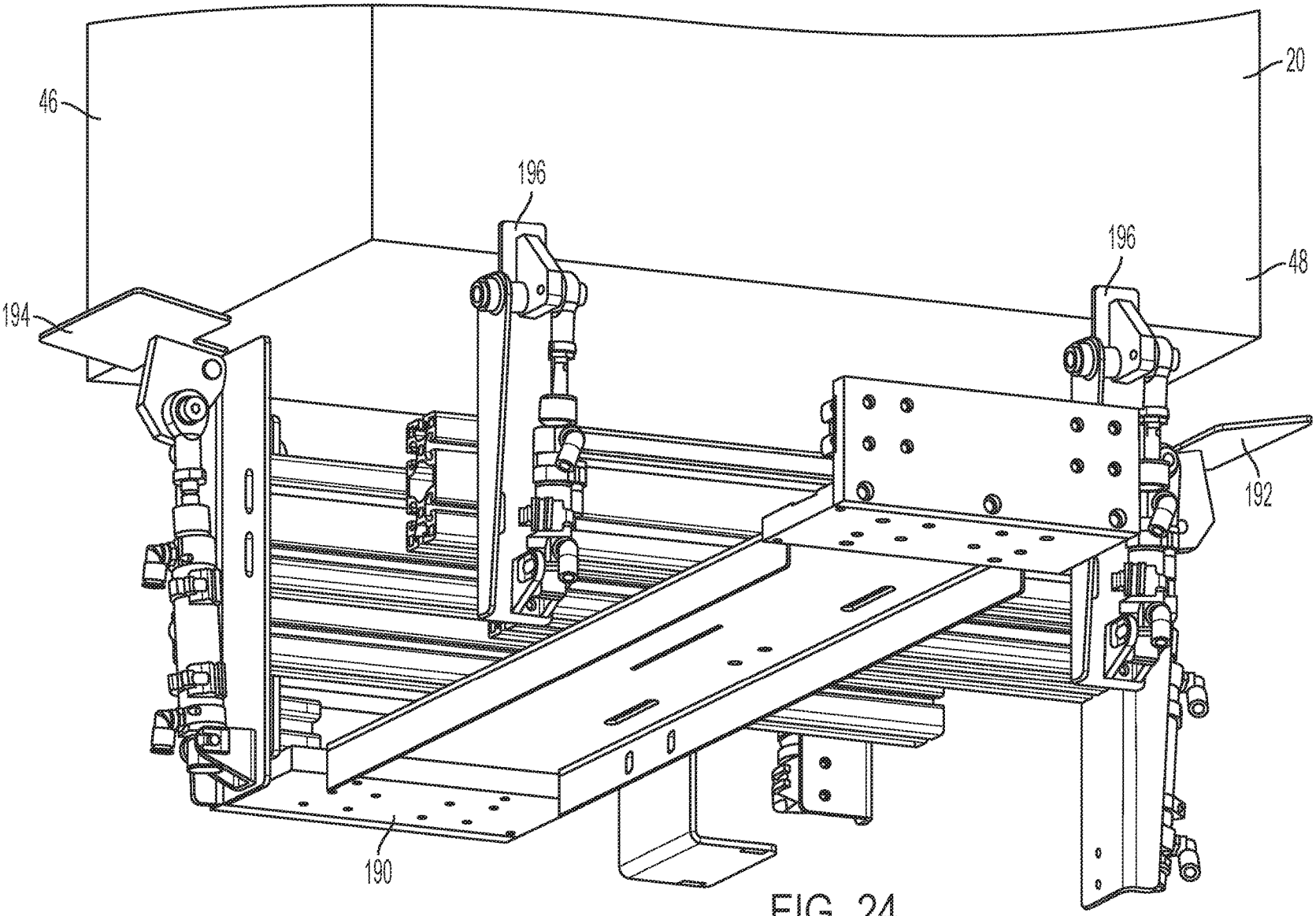
FIG. 24 is an enlarged perspective view of a portion of the flap-folding station of FIG. 19.
Figure 25:
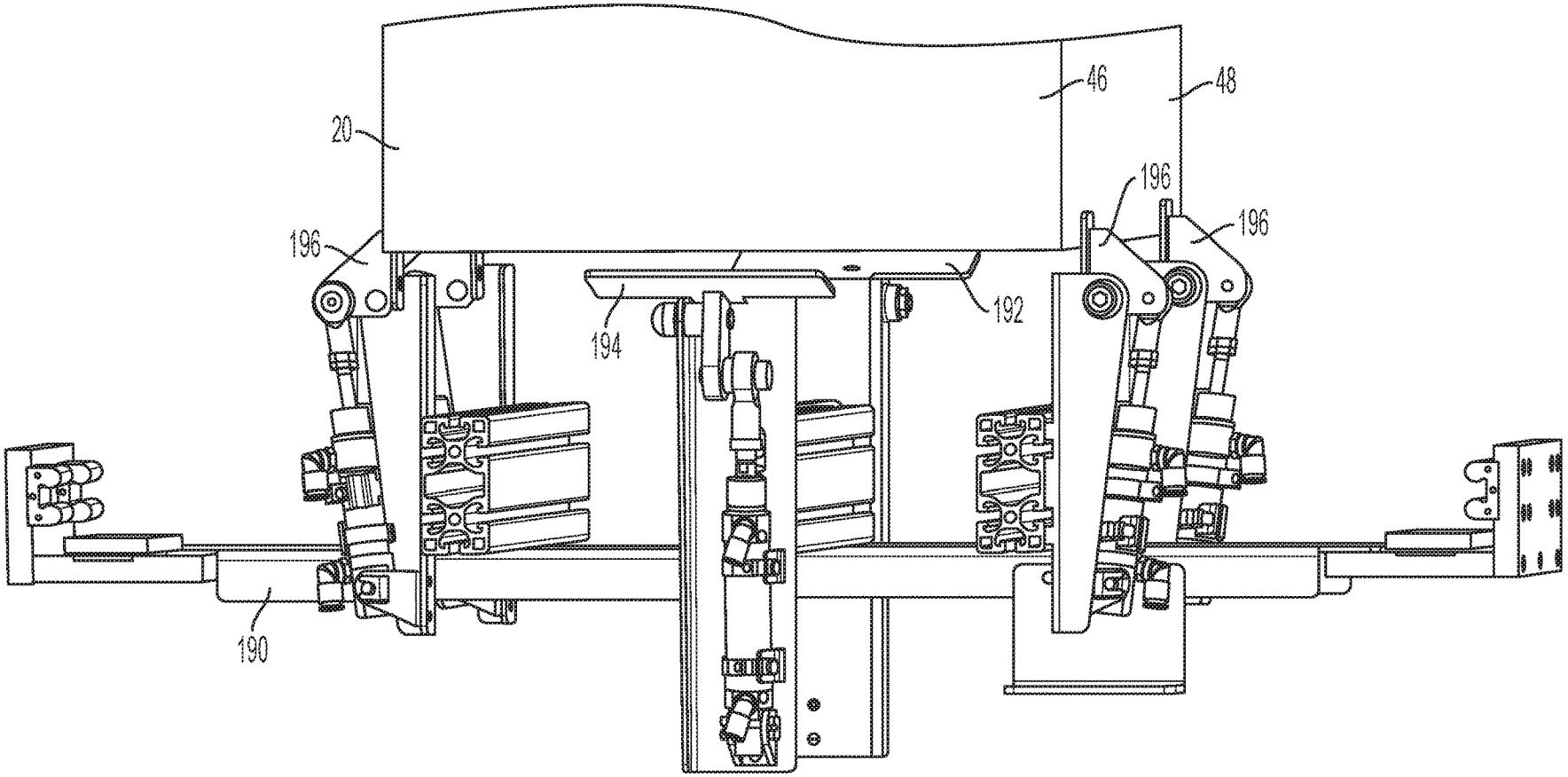
FIG. 25 is another perspective view of flap-folding station of FIG. 24.
Figure 26:
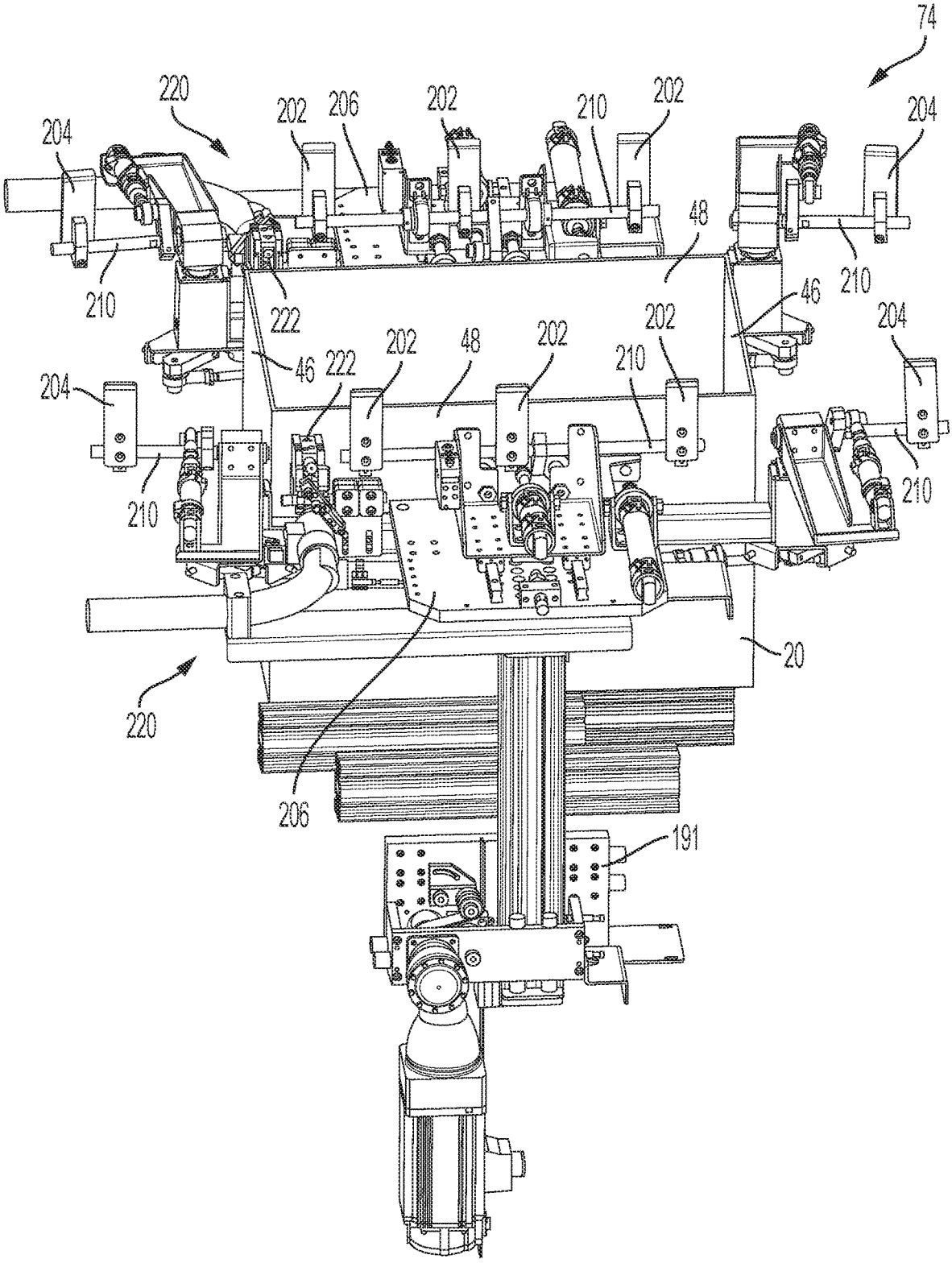
FIG. 26 is an enlarged perspective view of another portion of the flap-folding station of FIG. 19.
Figure 27:
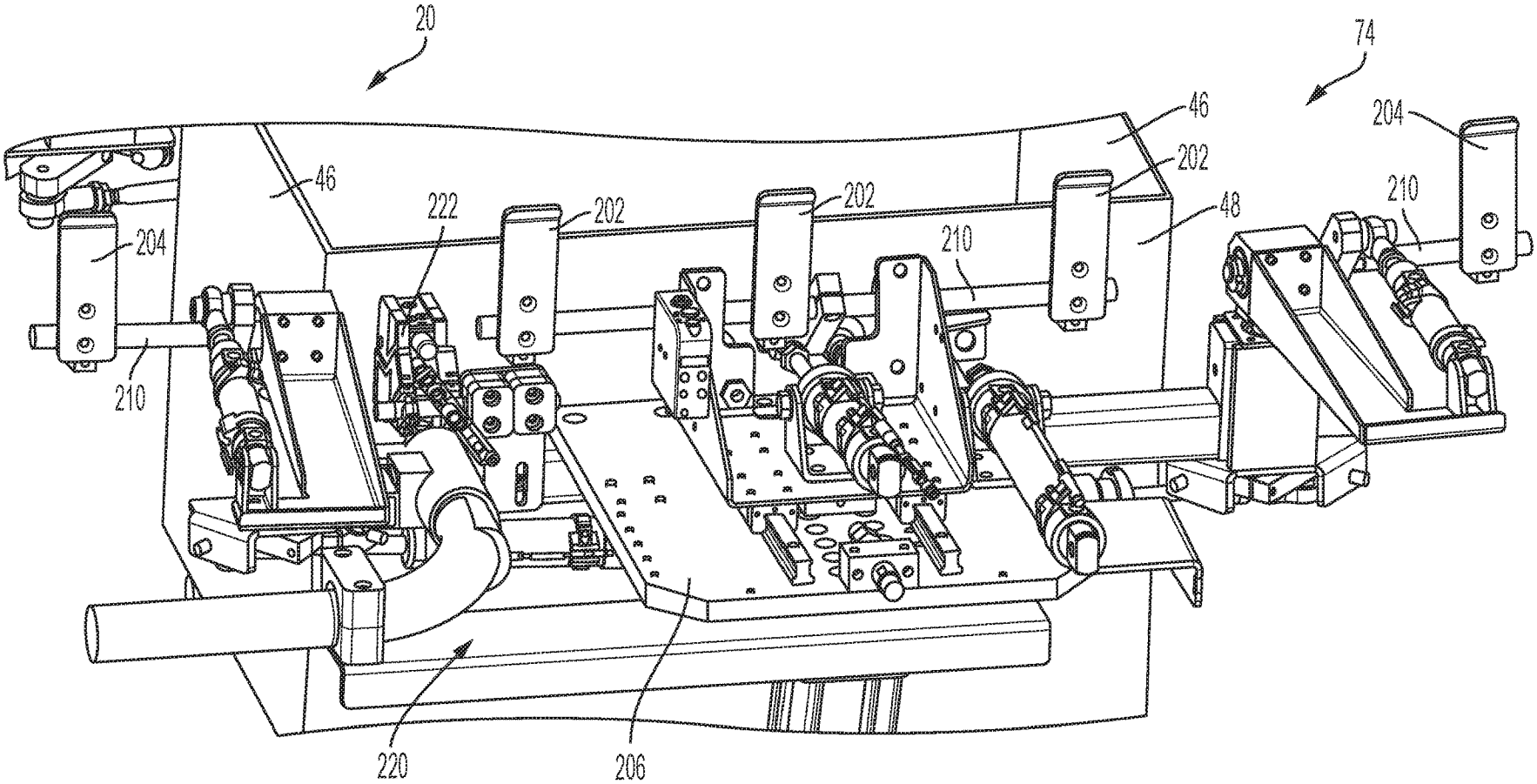
FIG. 27 is an enlarged perspective view of another portion of the flap-folding station of FIG. 26.
Figure 28:
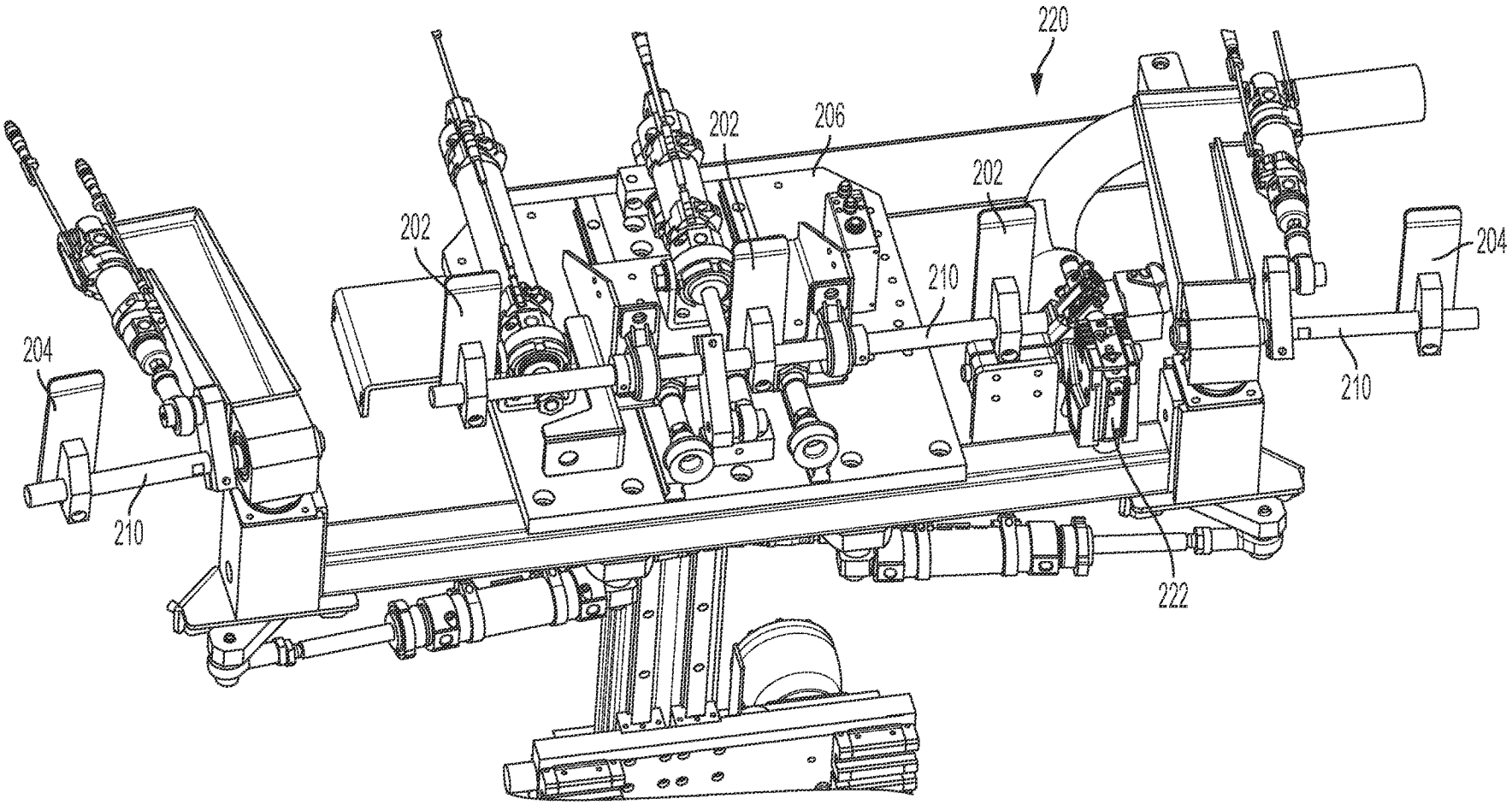
FIG. 28 is an enlarged perspective view of the portion of the flap-folding station of FIG. 27 as seen from an opposite side.
Figure 29:
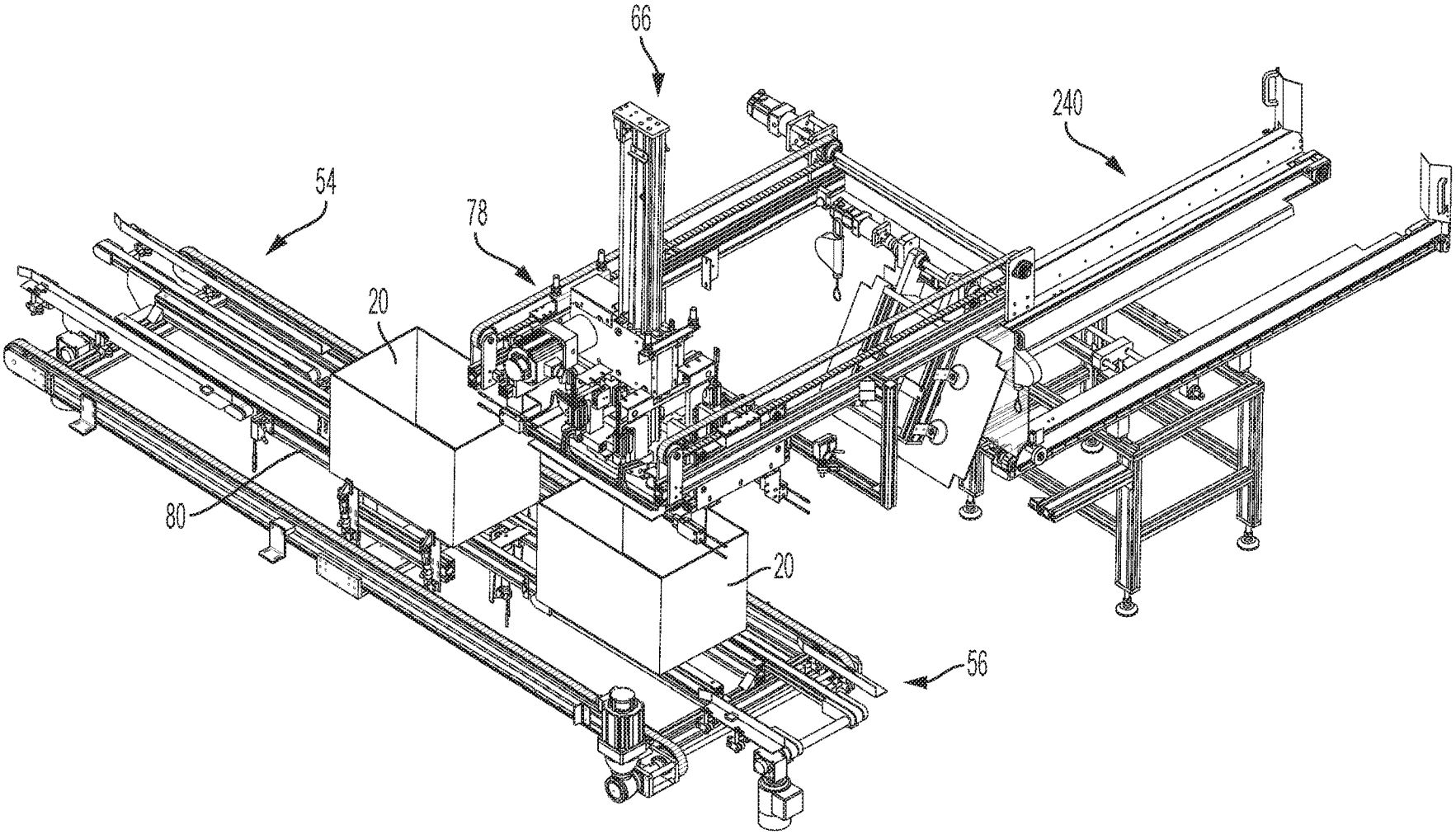
FIG. 29 is another perspective view of the automatic closing system of FIG. 6, with the flap-forming assembly and flap-folding assembly omitted, leaving the lidding station.
Figure 30:
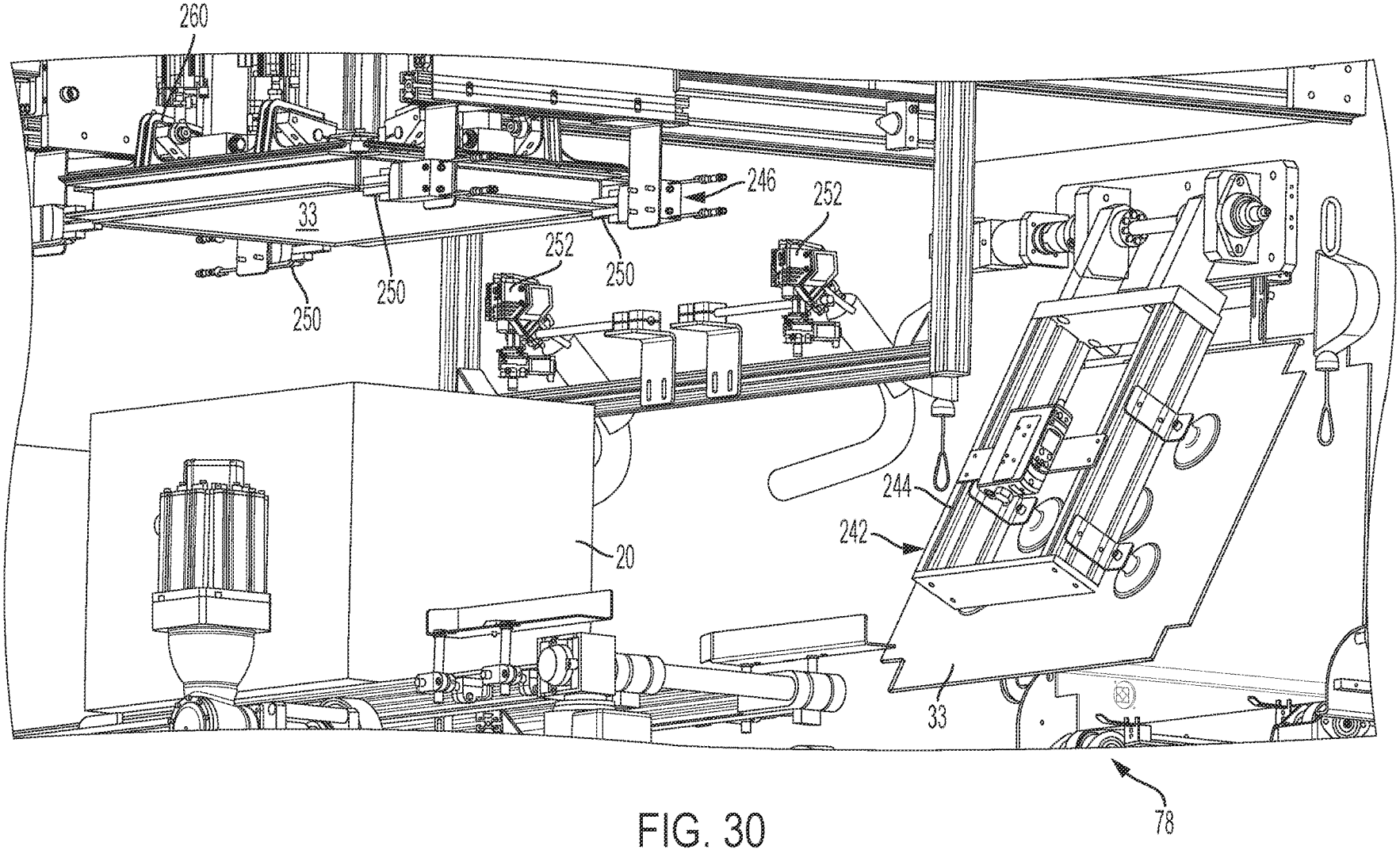
FIG. 30 is an enlarged perspective view of a portion of the lidding station of FIG. 29.
Figure 31:
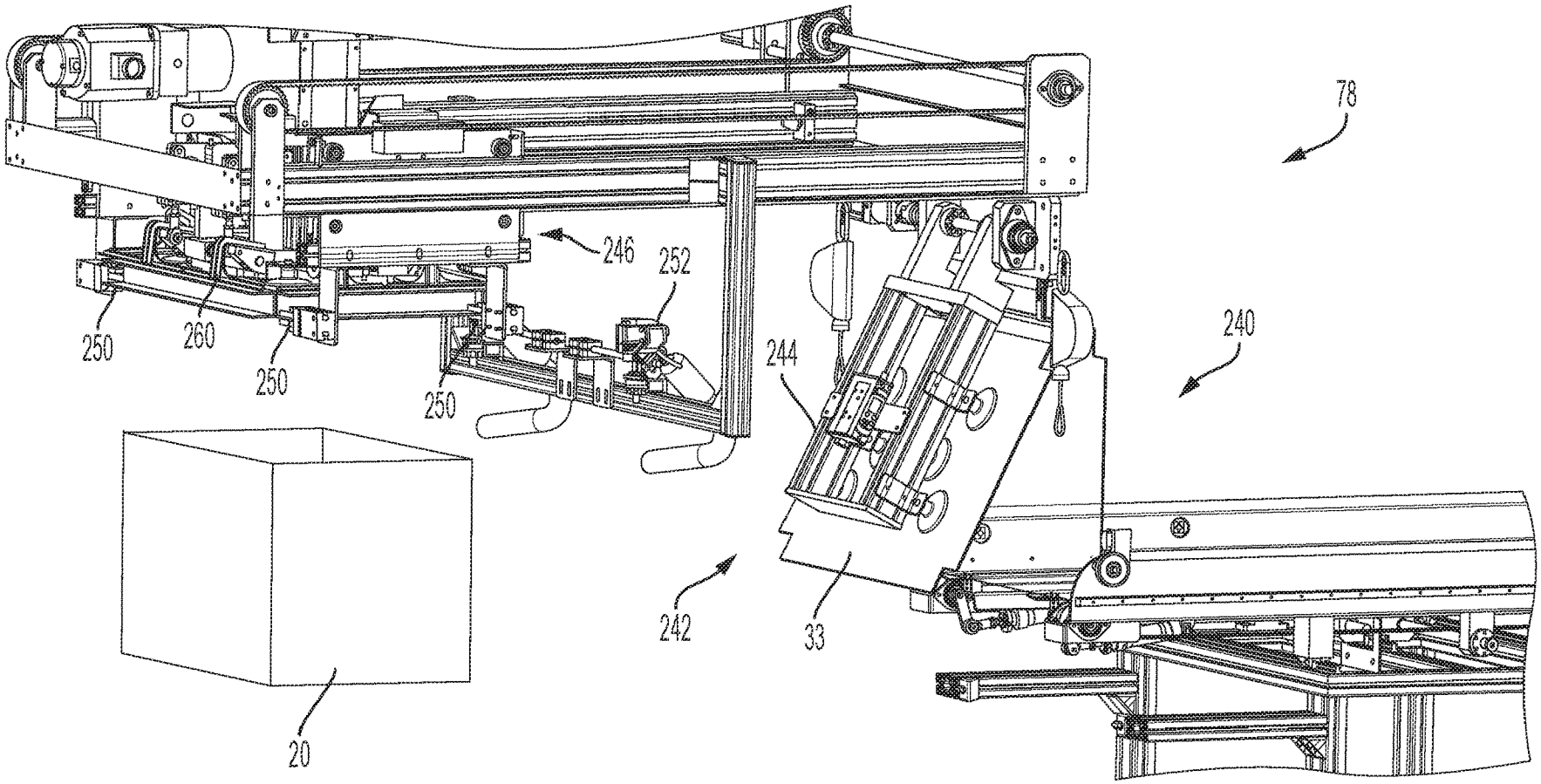
FIG. 31 is another perspective view of a portion of the lidding station of FIG. 29 without the container support structure.
Figure 32:
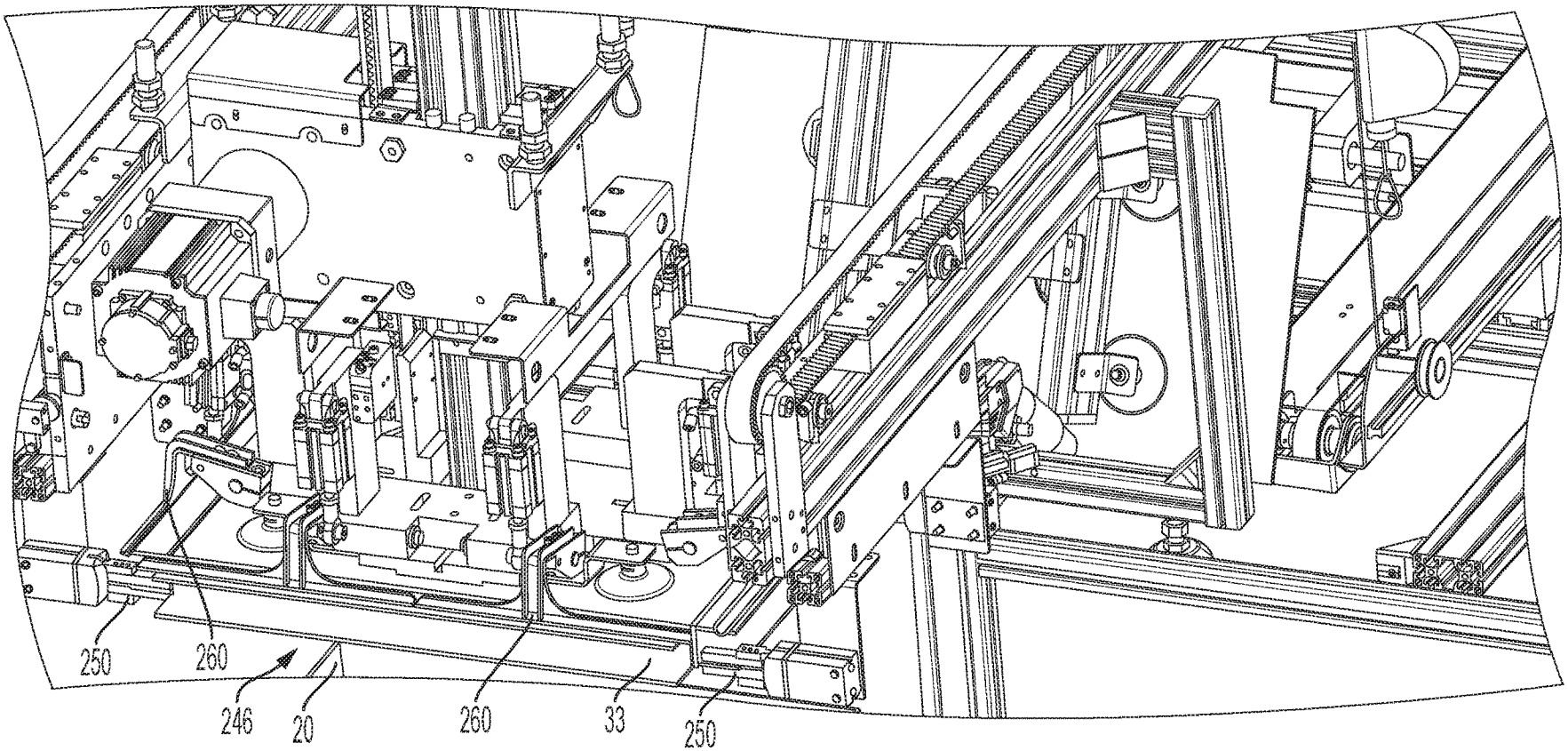
FIG. 32 is another enlarged perspective view of a portion of the lidding station of FIG. 29.
Figure 33:
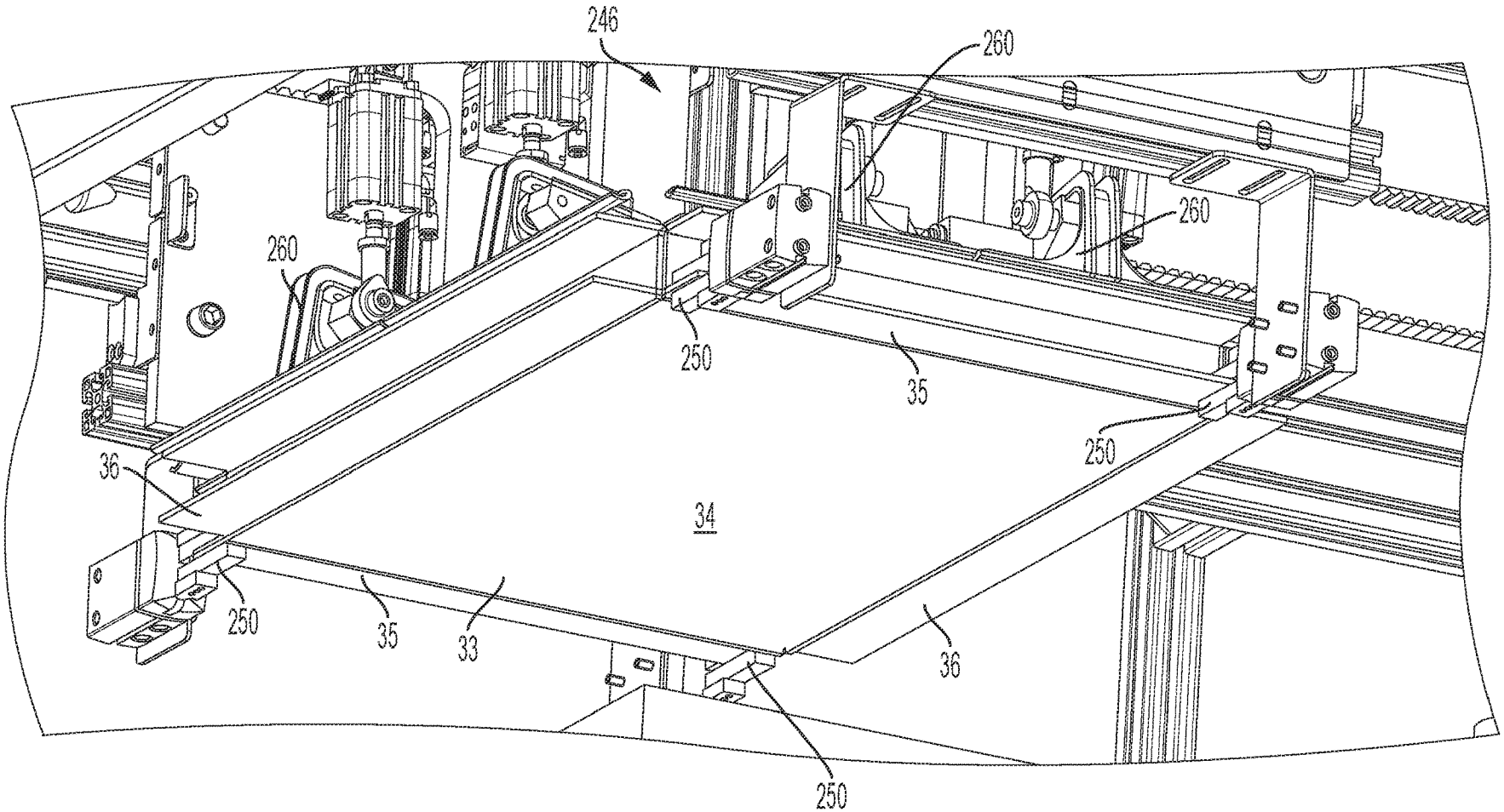
FIG. 33 is an is another enlarged perspective view of a portion of the lidding station of FIG. 29.
Figure 34:
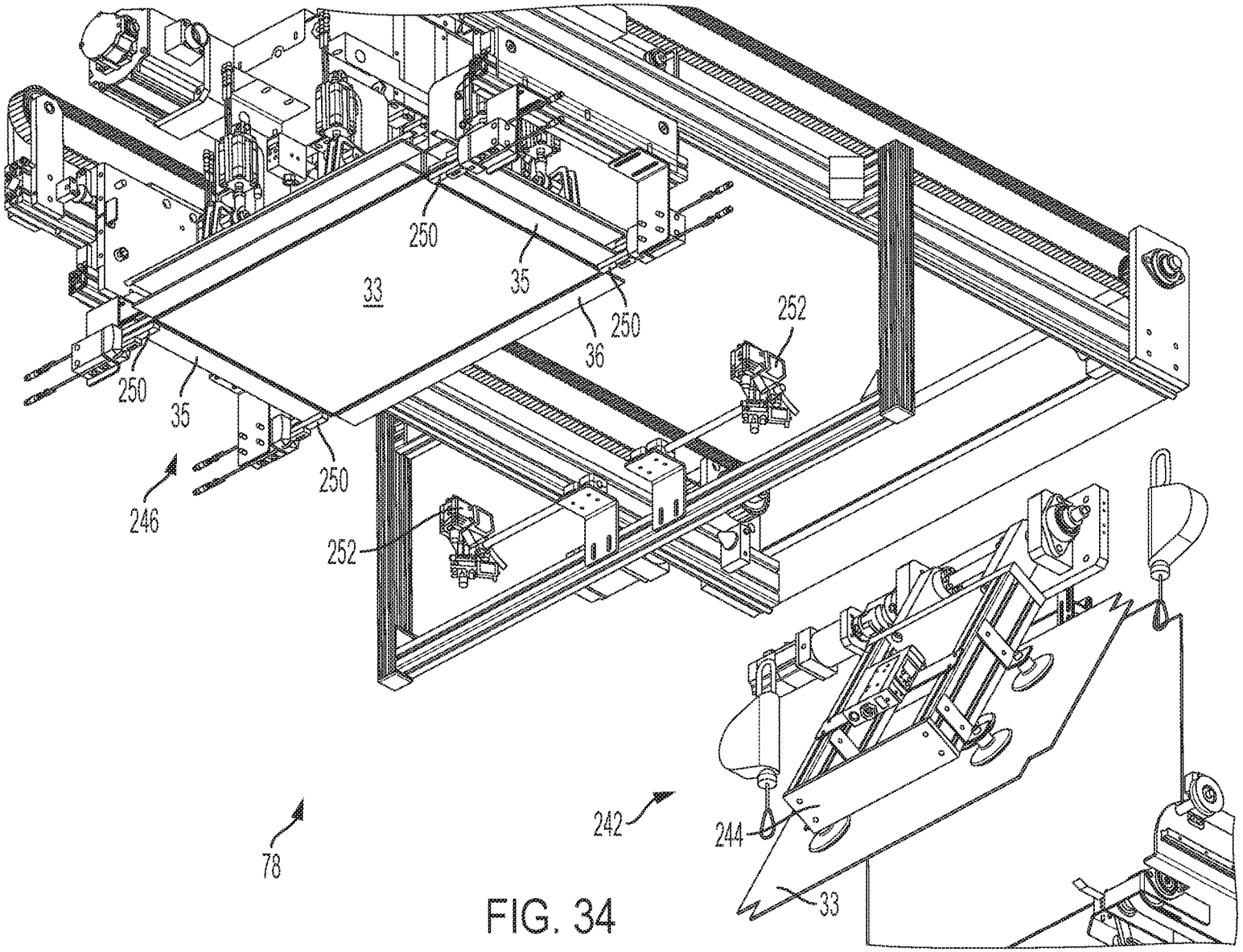
FIG. 34 is another enlarged perspective view of a portion of the lidding station of FIG. 29.

Turning now additionally to FIG. 9, the sensor 70 is the first component of the system 40 in communication with the controller 90 to indicate a height of a tallest item in the container 20. The sensor 70 may be provided at a separate station or may be integrated into the flap-forming station 62 and into the flap-forming assembly 72, inside the footprint of a container 20 at the flap-forming station 62. The sensor 70 detects the height of the tallest item in the box 20 and outputs a signal representing the detected height to the controller 90. The detected height is used in determining the length of the vertical flap cuts, the height of the horizontal fold lines, and the height of the flap-folding assembly 74 on the sled 76.

In the illustrated embodiment the sensor 70 includes one or more pressure plates, generally horizontal planar members sized to fit within the box 20 that are coupled to a sensor element, such as a pressure sensor, to detect when the plate 70 engages the tallest item in the container 20. The pressure plate 70 may be perforated, as shown, to reduce its weight. The pressure plate 70 typically is sized to be closely received through the open side, the open top 50, of the container 20. This ensures that the pressure plate 70 will contact the tallest item in the container 20, even if the tallest item is close to a side wall 46 or 48, and helps to minimize the opportunity for the plate 70 to catch on any lightweight items inside the container 20 as the plate 70 is retracted from the container 20. As the pressure plate 70 enters the box 20 it will engage the tallest item in the box 20. The illustrated sensor 70 provides an advantage over an optical sensor, in that an optical sensor may detect a stray piece of paper or another lightweight item in the container 20 as being the tallest item in the container 20. By using a pressure plate 70 and associated pressure sensor, a piece of paper or other lightweight packaging material in the container 20 is unlikely to trick the illustrated sensor 70 into identifying such part of the packaging material as providing the tallest item in the container 20.

The system 40 is not limited to the illustrated sensor 70, however, and may include any sensor that detects a height of the tallest item in the box 20, such as an optical sensor, a mechanical sensor that probes multiple areas within the box, etc. Alternatively, the sensor 70 may include a warehouse management system that identifies items in the box 20 using radio-frequency identification (RFID), a barcode, or other identifier and a look-up table of product dimensions stored in a memory incorporated into or accessible by the controller 90.

In the illustrated system 40, the sensor 70 operates inside the footprint of a container 20 at the flap-folding station 62 and is positioned above the container 20 so that the sensor 70 can look down into the open side 50 of the container 20 at the objects in the container 20. Because the sensor 70 needs to detect the tallest item in the container 20 to inform the actions of the flap-forming assembly 72, the sensor 70 may begin to check for the tallest item in the container 20 before or during operation of the flap-forming assembly 72, but must operate to detect the tallest item in the container 20 simultaneously with or before the flap-forming assembly 72 completes its operation.

Flap-Forming Station—Flap-Forming Assembly

The flap-forming assembly 72, also at the flap-forming station 62 with the sensor 70, generally includes a flap-cutting assembly 94 that vertically cuts the side walls 46 and 48 of the container 20 adjacent each corner 52 and a fold-line-forming assembly 96 that forms horizontal fold lines in the side walls 46 and 48 of the container 20 to form flaps in all four sides of the container 20. The fold-line-forming assembly 96 alternatively may be referred to as the fold-forming assembly or the creasing assembly. The fold lines are formed at a predetermined distance relative to the detected height of the tallest item the sensor 70 detects in the container 20, at, above, or below the height of the tallest item, and adjacent distal ends of the vertical cuts in the side walls 46 and 48.

In addition to the flap-cutting assembly 94 and the creasing assembly 96, the flap-forming assembly 72 includes a support structure 102 that is part of the frame assembly 100 and that supports the flap-cutting assembly 94 and the creasing assembly 96 from above, at an elevated position above the container 20 and the container support 80. The support structure 102 includes a support plate 104 to which the flap-cutting assembly 94 and the creasing assembly 96 are mounted. In the illustrated embodiment the sensor 70, specifically the pressure plate 70, is mounted to the support plate 104 inside a volume bounded by elements of the flap-cutting assembly 94 and the creasing assembly 96 to provide a more compact flap-forming station 62.

The support structure 102 also includes a vertical rail 106 and a motive element for moving the support plate 104 vertically along the rail 106, which is supported above the container support 80 by the frame assembly 100. The support plate 104 may be moved relative to the vertical rail by any means for moving an object, including a pneumatic actuator, a hydraulic actuator, a servomotor, etc. The illustrated flap-forming assembly 72 employs a servomotor 108 to move the support plate 104 vertically along the rail 106 from an elevated ready position to a fold-line-forming or creasing position below the ready position at a location based on the height detected by the sensor 70. The servomotor 108 may be provided with an encoder, also referred to as a coder, to provide an output indicative of a distance that the servomotor 108 has moved the support plate 104 relative to a starting or reset position above the container support 80. This vertical movement also provides the vertical cutting function and positions the creasing assembly 96 at a desired height to form the horizontal fold lines.

Flap-Cutting Assembly

The vertical cuts in the container 20 are made simultaneously by the flap-cutting assembly 94, formed by four separate cutting assemblies 112, providing means for making respective vertical cuts adjacent respective corners 52 in the container 20. The cutting assemblies 112 are mounted to the support plate 104 for vertical movement with the support plate 104.

In the illustrated embodiment shown in further details in FIGS. 9 to 16, each cutting assembly 112 includes a cutting blade 114 supported in a housing 116 that is mounted at a distal end of a support arm 120 that is pivotally mounted to the support plate 104. Consequently, the support arm 120 also may be referred to as a pivot arm. The pivot arm 120 is configured to move the housing 116, and the cutting blade 114, from a rest position away from a container 20 toward a cutting position inwardly spaced from the rest position and closer to the container 20. In the illustrated embodiment an actuator 121 mounted between the support plate 104 and a proximal end of the pivot arm 120 moves the cutting blade 114 and the housing 116 from the rest position toward the cutting position, pivoting the pivot arm 120 about a pivot axis defined by a pivot pin 122 coupled to a scissoring support arm 124 for the creasing assembly 96.

While the pivot arm 120 for the cutting assembly 112 moves the housing 116 axially inward, the housing 116 also is mounted to move transversely relative to the distal end of the pivot arm 120 through a pair of parallel dovetail guides 125 and a housing actuator 126 mounted to the pivot arm 122 adjacent the housing 116. Thus, the housing 116 and the cutting blade 114 move laterally inwardly to position the cutting blade 114 over the side wall 46 of the container 20 to be cut a predetermined distance from a corner 52 of the container 20. The flap-cutting assembly 94 typically includes a pair of cutting blades 114 in respective cutting assemblies 112, with a respective one of the two cutting blades 114 in each of two parallel planes, the planes being spaced apart a distance less than a width of the container 20. In other words, the cutting blades 114 are inwardly spaced from an outer edge of the container 20, typically a distance slightly larger than the thickness of the walls of the container 20.

The dovetail guides 125 control a translating movement of the housing 116 relative to the pivot arm 120 in a transverse direction, transversely inward toward the cutting position. The dovetail guides 125 and the pivot arm 120 thus cooperate to move the housing 116 and the cutting blade 114 axially and transversely between the rest position and the cutting position.

To assist in maintaining the spacing between the corner 52 of the container 20 and the cutting blade 114 in the cutting position, a guide element, also called a container stabilizer or stabilizing element 130, is mounted to and extends from the housing 116 at a location spaced outwardly from and below the cutting blade 114. The stabilizing element 130 has a vertical control surface that is spaced from the cutting blade 114 in a parallel plane. The stabilizing element 130 is configured to engage a transverse side wall 48 of the container 20 to define a spacing between the corner 52 of the container 20 and the plane along which the cutting blade 114 will cut the axial side wall 46. By being attached to the cutting blade housing 116, the stabilizing elements 130 will always move with the cutting blade 114 and act as a cutting guide defining a constant spacing for the cutting blade 114 from the adjacent side wall 48 of the container 20. The stabilizing elements 130 of adjacent cutting assembly pairs on each axial side of the container 20 engage opposing transverse side walls 48 of the container 20 and cooperate to stabilize the transverse side walls 48 adjacent the cutting blades 114 as they cut. Cutting includes any type of separation of the container material that severs one portion of the container 20 from another portion of the container 20.

The housing 116 also may include stabilizing guide rollers 132 positioned below the cutting blade 114 that ride against the axial side wall 46 of the container 20 that is being cut, adjacent the corner 52 formed with the transverse side wall 48. The stabilizing guide rollers 132 are stabilizing elements that stabilize the wall of the container 20 that is being cut and move with the cutting blade 114 to counteract the outwardly-directed force generated by the cutting blade 114 as it acts on the wall of the container 20. The stabilizing rollers of opposing cutting assemblies stabilize the container in the axial direction between the opposing cutting assemblies 112 engaging opposing axial sides of the container 20. The container 20 is thus pinched between all four cutting assemblies 112 and stabilized adjacent respective cutting blades 114 during the cutting operation.

The cutting position typically is predetermined as a function of the size of the container 20. Alternatively, however the cutting position may be determined or adjusted using one or more sensors to provide feedback to automate the positioning of the housing 116 and the cutting blade 114 relative to the side walls 46 and 48 of the container 20. In the cutting position, the cutting blade 114 extends perpendicular to and across a plane of the side wall 46 to be cut.

The cutting assembly 112 also includes a cutting motor 134 or other means for moving the cutting blade 114 relative to the housing 116. The cutting blade 114 has a cutting edge 136, and is coupled to the cutting motor 134 for axially advancing the blade 114 in a forward direction generally parallel to the cutting edge 136 prior to the cutting operation, and retracting the cutting blade 114 in a reverse direction opposite the forward direction as the cutting blade 114 moves vertically downward with the support plate 104 during the cutting operation. In the illustrated embodiment, the housing 116 supports the cutting blade 114 in a vertical plane, with the cutting edge 136 in a non-horizontal orientation. The cutting blade 114 is coupled to a rack 140 for movement with the rack 140, and the motor 134 is coupled to the housing 116 and a pinion gear 142 that engages the rack 140 to drive the forward and reverse motion of the cutting blade 114 relative to the housing 116. To control the extended and retracted positions of the cutting blade 114, the pinion gear 142 is coupled to a control arm 144 that rotates with the pinion gear 142 between respective control switches or position sensors 146, 148 that are mounted to the housing 116 and are circumferentially positioned in the path of the control arm 144. The control switches 146, 148 are positioned to correspond to extended and retracted positions of the cutting blade 114, and output a signal when engaged by the control arm 144 that signals the motor 134 to stop.

The cutting blade 114 advances and retracts axially, parallel to the cutting edge 136, along an axis that is inclined relative to horizontal by about ten degrees to about 80 degrees, more preferably about twenty to degrees to seventy degrees, more preferably about thirty degrees to about sixty degrees, and more preferably about forty-five degrees. The motor 134 is controlled to extend the cutting blade 114 to its extended position prior to engaging the top of the side wall 46 of the container 20 and to retract the cutting blade 114 to its retracted position axially outwardly as the cutting blade 114 moves vertically downward, slicing the side wall 46 until reaching the distal end of the cut in response to the signal generated by the sensor 70 detecting the tallest item in the container 20.

Accordingly, during the cutting operation, as the cutting blade 114 is moved vertically downward, the cutting blade 114 also is retracted, moving axially outward, away from an opposing cutting blade 114 adjacent an opposing axial side wall 46 of the container 20. As the cutting blade 114 moves outward, different portions of the cutting blade 114 engage the side wall 46 of the container 20, slicing the side wall 46 as the cutting blade 114 moves in the outward direction only. The slicing action produces minimal dust and makes use of a greater extent along a length of the cutting edge 136, bringing sequential portions of the cutting edge 136 into engagement with the side wall 46, to maximize the time between sharpening or replacing the cutting blade 114. With the inclined cutting edge 136, the cutting blade 114 also is angled upward into the container 20, which minimizes the effort required in slicing the side wall 46 of the container 20. Additionally, due to the upwardly-angled orientation of the cutting blade, at the distal end of the cut the pivot arm 120 is actuated to move the cutting blade 114 out of engagement with the side wall 46 to minimize additional cutting of the side wall 46. Moreover, an angled or inclined cutting blade 114 is easier to move through a container side wall 46.

In contrast, static cutting blades that only move vertically downward wear in a narrow portion of the cutting edge, get hotter, and generate more dust. And vibrating cutting blades that oscillate rapidly, moving the cutting blade back and forth across the side wall of the container in opposite directions many times creates even more dust than static blades. Consequently, by moving the cutting blade 114 during the cut to expose more portions of the cutting edge 136 to the side wall 46 of the container 20 without reversing direction during the cut, the cutting blade 114 lasts longer and produces less dust than prior techniques. Holding the cutting blade 114 at a non-horizontal angle puts more of the cutting edge 136 in contact with the side wall 46 of the container 20 and reduces the force required to move the cutting blade 114 through the side wall 46 of the container 20.

Some cardboard containers have partial double walls adjacent one corner where a container has been erected, and typically this doubled wall is on a transverse side wall 48 of the container. Consequently, containers 20 often are cut only in the axial side walls 46 of the container 20 to avoid the doubled wall portion. As a result, the cutting blade 114 typically is spaced from an outside edge of a corner 52 by a distance equivalent to at least two thicknesses of the side wall 46 or 48. Thus, when the side walls are cut by the cutting blades 114, portions of the axial side wall 46 adjacent the corner 52 may remain attached to the adjacent transverse side wall 48 to form a flange between the vertical cut and the corner 52 of the container 20. Generally, this extra flange is pushed outward as the flap formed from the transverse side wall 48 is folded downward, toward a position in a common plane with the transverse flap as the transverse flap is closed, allowing the flap to lie flat in a horizontal orientation.

In operation, when a container 20 arrives at the flap-forming station, the cutting blades 114 are extended and the housings 116 are moved inwardly from the rest position into the cutting position, engaging respective side walls 46 and 48 at each corner 52 of the container 20 and pinching the container 20 between the cutting assemblies 112. Once the housing 116 is in position against the side of the container 20, and the cutting blade 114 is extended, the cutting assembly 112 is ready to cut the side walls 46 of the container 20. All four cutting assemblies 112 may move into position simultaneously. No one cutting assembly 112 has to wait for another cutting assembly 112. The support plate 104 moves vertically downward to initiate the cut, and the cutting blades 114 slice through the side walls 46, stopping at a vertical position a predetermined distance relative to the top of the tallest item detected by the sensor 70. During the cutting operation, the cutting blade 114 axially retracts to continually present a fresh portion of the cutting edge 136 to the side wall 46 of the container 20 being cut. At the distal end of the cut, the pivot arm 120 moves the cutting blade 114 axially outwardly, out of engagement with the side wall 46 of the container 20, and when the cutting blade 114 is free of the container 20 the actuator 126 may move the housing 116 laterally outwardly on the dovetail guides 125 to the rest position. Once the fold lines are formed in the side walls 46 and 48, the support plate 104 can return to its elevated ready position, ready for the next container 20.

Fold-Line-Forming Assembly

The fold-line-forming-assembly 96, alternatively referred to as the fold-forming assembly or the creasing assembly for brevity, forms horizontal fold lines in each of the side walls 46 and 48, between distal ends of the vertical cuts in the side walls formed by the flap-cutting assembly 94, by pinching each of the side walls 46 and 48 between pairs of creasing elements 158 that crimp, crease, or otherwise weaken the side walls 46 and 48 of the container 20 and thereby form a fold line on all four side walls 46 and 48. The fold lines are formed in a generally horizontal plane, in horizontal lines on all four sides of the container. The fold line forms a hinge and a hinge axis about which the flap will rotate when a force is applied to the flap above the fold line, generally inward toward an interior of the container 20.

The creasing assembly 96 forms the fold lines after the sensor 70 detects the height of the tallest item in the container 20, and may operate to form the fold lines before, during, or after the side walls 46 and 48 of the container are cut by the flap-cutting assembly 94. Respective pairs of creasing elements 158 may form the fold lines in all four side walls 46 and 48 simultaneously, in sequential pairs of opposing side walls 46 or 48, or each side wall 46 or 48 sequentially.

The creasing elements 158 include an inner creasing member 160 and an outer creasing member 162. The creasing elements 158 typically have the same length and thus typically are sized for the inner creasing member 160 to be received inside the container 20. One of the creasing elements 158, such as the inner creasing member 160 inside the container 20, also may perforate the inner surface of the side wall 46 or 48.

The creasing elements 158 are supported at distal ends of respective scissor-arm assemblies 166 connected to the support plate 104 at their proximal ends. Each scissor-arm assembly includes a pair of scissor arms 170 and 172 connected together at an intermediate point by the pivot pin 122. One scissor arm 170 may be pivotably mounted to the support plate 104 and the other scissor arm 172 may be connected to a scissor actuator 174 mounted on the support plate 104 to generate the pinching movement of the creasing elements 158. The scissor arms 170 and 172 are pivotably connected to one another in between their proximal and distal ends by the pivot pin 122. Accordingly, the inner and outer creasing members 160 and 162 are connected to the support plate 104 via the scissor arms 170 and 172 and the scissor actuator 174 in such a way that prior to activation the inner and outer creasing members 160 and 162 are spaced apart, and can be lowered to a fold-line-forming creasing position with a side wall 46 or 48 of the container 20 interposed between the inner and outer creasing members 160 and 162. Activation of the scissor actuator 174 causes the inner and outer creasing members 160 and 162 to move together toward each other to crimp the side wall 46 or 48 of the container 20 between the inner and outer creasing members 160 and 162. In other words, the actuation and support structure for the creasing elements 158 is configured to move the inner and outer creasing members 160 and 162 to crimp the side wall 46 or 48 of the container 20 to form the fold lines.

The fold lines may be continuous and may or may not extend all the way to each corner 52 of the container 20 between which the side wall 46 or 48 extends. But the inner and outer creasing elements 160 and 162 typically span the entire distance between adjacent corners 52 of an adjacent surface of the side wall 46 or 48 of the container 20. To accommodate different size containers, the inner and outer creasing members 160 and 162 mounted at the distal ends of the scissor arms 170 and 172 can be replaced with creasing elements 158 of the appropriate length, and the position of the scissor arm assembly 166 can be adjusted relative to the support plate 104. To facilitate that adjustment, the illustrated support plate 104 includes parallel slots for each scissor-arm assembly 166 to be moved inwardly or outwardly to accommodate a range of container sizes. The distance moved by the inner and outer creasing members 160 and 162 between a rest position spaced from the side walls 46 or 48 of the container 20 and a crimping position where both the inner creasing member 160 and the outer creasing member 162 are in engagement with the side wall 46 or 48 of the container 20 may remain constant for different size containers.

When a container 20 arrives at the flap-forming station 62, the flap-cutting assembly 94 moves the cutting blades 114 to the extended cutting position, and the sensor 70 operates to detect the tallest item in the container 20. The sensor in the illustrated embodiment includes the support plate 70, suspended below the support plate 104. As the support plate 104 descends, the cutting blades 114 slice the side walls 46 of the container 20 adjacent all four corners 52 simultaneously from a top edge of the side wall 46 to a distal end of the cut, which is based on the detected height of the tallest item in the container 20. For example, the sensor 70 may output a signal to indicate when the pressure plate has engaged the tallest item in the container 20, and the controller 90 may stop the servomotor 108 upon receiving that signal. The items in the container 20 typically have a minimum height inside the container of 25 mm to 60 mm. The creasing assembly 96 forms horizontal fold lines in the side walls 46 and 48 of the container 20 a predetermined distance relative to the height of the detected tallest item in the container 20, and the servomotor 108 reverses, raising the support plate 104, the flap-cutting assembly 94, and the creasing assembly 96 back to the ready position above the container 20. The formation of the flaps in the side walls 46 and 48 of the container 20 is complete, and the flaps are ready to be folded inward.

Flap-Folding Station

Unlike prior container-closing systems that used a conveyor to transport a series of containers through the system, the present invention provides a container-closing system 40 that uses a sled 76 as a basis for a movable flap-folding station 64 to move containers 20 from the flap-forming station 62 to the lidding station 66. The sled 76 includes a carriage that translates with the container 20, and the carriage 20 may include means to hold the container to the carriage and/or one or more other mechanisms that move with the carriage. Unlike the vertically-moving components of the flap-forming assembly 72, the flap-folding station 64 moves containers 20 horizontally along the container support 80 from the flap-forming station 62 downstream to the lidding station 66, moving one or more containers 20 through the system 40 simultaneously.

Turning now particularly to FIGS. 18 to 28, the illustrated sled 76 can move two containers 20 simultaneously, from an intake position at the upstream end 54 of the container support 80, and then downstream to the flap-forming station 62, the lidding station 66, and then to an output position at the downstream end 56 of the container support 80. Powered conveyors upstream and downstream of the system 40 may deliver containers to the intake position and collect containers from the output position, but the sled 76 moves the containers 20 through the system 40. For example, a container 20 may be retrieved from the intake position and moved to the flap-forming station 62 at the same time that a container 20 is removed from the flap-forming station 62 and moved to the lidding station 66. Or a container 20 can be moved from the flap-forming station 62 to the lidding station 66 while the sled 76 moves a container 20 from the lidding station 66 to the output position downstream of the lidding station 66.

The flap-folding assembly 74 is mounted on the sled 76 and is configured to inwardly fold the flaps on the container 20 from a generally vertical orientation in line with the side walls 46 and 48 of the container 20 to a generally horizontal orientation extending over the open top 50 of the container 20. The flaps are portions of the side walls 46 and 48 between the vertical cuts formed by the cutting assembly 94 and above the fold lines formed by the creasing assembly 96. The flap-folding station 64 provided by the invention thus saves time by folding the flaps inwardly while also moving the container 20 to the lidding station 66.

The sled 76 includes a pair of driven friction plates 190 and 191 that move below the container support 80. The friction plates 190 and 191 are coupled for common movement horizontally along the container support 80, and the friction plates 190 and 191 are connected to means for moving the sled 76 along the container support 80. The container support 80 may function as a support frame for supporting both the sled 76 and the containers 20, while also functioning to guide the sled 76 or the containers 20 or both. The friction plates 190 and 191 have upstream and downstream axial clamping fingers 192 and 194 that extend above the container support 80 to engage axial side walls 46 of the container 20. The axial clamping fingers 192 and 194 are retractable below the upper surface of the container support 80 to permit the sled 76 to move to engage a next container 20. For example, the sled 76 may move a container 20 to the lidding station 66, retract the axial clamping fingers 192, and move to the flap-forming station 62 to engage a container 20 at the flap-forming station 62. While the axial clamping fingers 192 and 194 grasp the container 20 therebetween axially, the sled 76 also may include transverse clamping fingers 196 that may engage the transverse side walls 48 to pinch the side walls 48 transversely therebetween.

The flap-folding assembly 74 is mounted for horizontal movement with the sled 76 and includes two sets of flap-folding fingers 202 and 204 that are pivotally mounted to respective platforms 206 on opposing transversely-spaced sides of the container support 80 to engage a container 20 therebetween. Each set of flap-folding fingers includes transverse flap-closing fingers 202 and axial flap-closing fingers 204.

The flap-folding fingers 202 and 204 are mounted for rotation about a proximal end and engage an adjacent side wall 46 or 48 of the container 20 above the fold line and push the flap inward with a portion of the finger 202 or 204 extending from the proximal end toward the distal end. Accordingly, the flap-folding assembly 74 also includes means for adjusting the vertical position of its flap-folding fingers 202 and 204 based on the position of the fold line, which is determined relative to the height of the tallest item in the container 20 detected by the sensor 70.

The platform 206 is coupled to a vertical rail for vertical movement relative to the container support 80 and is controlled to move the flap-closing fingers 202 and 204 to an appropriate height relative to the fold line. The platform 206 is transversely movable between a transport position transversely spaced from the path of the containers 20 on the container support 80, and a folding position horizontally removed from the transport position where the transverse flap-folding fingers 202 engage transverse side walls 48 of the container 20. The axial flap-folding fingers 204 also are pivotable about vertical axes to rotate through approximately ninety degrees to a folding position in the path of the container 20 and in engagement with axial side walls 46 of the container 20. In the illustrated embodiment, an axial flap-folding finger 202 from each transverse side of the container support 80 cooperate to fold the axial flaps inward. Alternatively, one or more axial flap-folding fingers 204 may be pivotable from a common side of the container support 80 to engage an axial side wall 46 and fold an axial flap without the assistance of a flap-folding finger 204 supported on an opposing platform 206.

In the illustrated embodiment, each flap-folding finger 202 and 204 is mounted near a proximal end to and extends from a crank shaft 210 and is rotatable with the crank shaft 210 from an upright orientation to a horizontal orientation to push against an adjacent flap, to move the flap from an upright open orientation in line with the side wall 46 or 48 toward a horizontal closed orientation extending over the open top 50 of the container 20. Multiple flap-folding fingers 202 and 204 may be mounted to a common crank shaft 210, and multiple flap-folding fingers may act on each flap. The crank shaft 210 may be continuous or may be formed of multiple segments that work together to rotate the flap-folding fingers 202 and 204 toward the container 20.

Once the flap-folding fingers 202 and 204 are in engagement with respective side walls 46 and 48 of the container 20, in the flap-closing position, rotation of the crank shafts 210 rotates the flap-folding fingers 202 and 204 to push on the flaps above the fold line, pushing the flaps inward. Typically, one of opposing axial or transverse pairs of flap-folding fingers 202 or 204 operate to fold opposing flaps before the other of opposing axial or transverse pairs of flap-folding fingers 202 or 204 operate to close opposing flaps. The flaps generally are inwardly folded sequentially, to allow for the possibility that opposing flaps may overlap one another. If the flaps are too short to overlap, opposing flaps may be inwardly folded simultaneously, with orthogonal pairs being folded inwardly sequentially—meaning, for example, that the axial flaps may be folded simultaneously and then subsequently the transverse flaps may be folded simultaneously. The flap-folding fingers 202 and 204 are substantially flat, which permits orthogonal flaps to fold over top of the flap-folding fingers 202 or 204 so that the flap-folding fingers 202 and 204 can hold the folded flaps in a closed, horizontal orientation as the sled 70 moves the container 20 to the lidding station 66. At or before the lidding station 66, the axial flap-folding fingers 204 are rotated about the vertical axis to remove them from engagement with the container 20, and the crank shafts 210 rotate the flap-folding fingers 202 and 204 from the horizontal flap-folding position to their upright position. This typically will be effected in such a way that the flaps cannot return to their upright orientation, such as when a lid is about to be placed over the inwardly-folded flaps. Specifically, once a lid is positioned above the container 20 a distance that is less than the length of the flaps so that the flaps cannot open beyond the lid. Or once an adhesive or other means for securing the flaps in their horizontal orientation has been activated. Once the flap-folding fingers 202 and 204 have been retracted and rotated back to upright orientations, the platform 206 supporting the flap-folding fingers 202 and 204 is moved outward, and the sled 76 moves the flap-folding assembly 74 upstream to be ready to move the next container or containers.

The illustrated flap-folding assembly 74 also includes a gluing assembly 220 to assist the lidding assembly 78. The gluing assembly 220 includes a supply of adhesive in a glue dispenser 222 mounted to the platform 206. As the sled 76 moves upstream to engage a container 20 at the flap-forming station 62, the flap-folding assembly 74 adjusts the position of the platform 206 vertically to a desired position relative to the height of the fold line. As the platform 206, and specifically the glue dispenser 222, moves upstream past the transverse side walls 48, the glue dispenser 222 is controlled to apply a line of adhesive to the transverse side walls 48 of the container 20 below the fold line along each of the opposing outwardly-facing transverse side walls 48. This adhesive will facilitate securing a lid to the container 20 at the lidding station 66. Thus, the gluing assembly 220 includes glue dispensers 222 that move horizontally with the sled 76 and are vertically positioned at the proper height with the flap-folding fingers 202 and 204 on the flap-folding assembly 76 based on the height detected by the sensor 70 to apply adhesive to the transverse side walls 48 of the container 20 as the sled 76 moves the container 20 from the flap-forming station 62 to the lidding station 66.

Lidding Station

Figure 3:
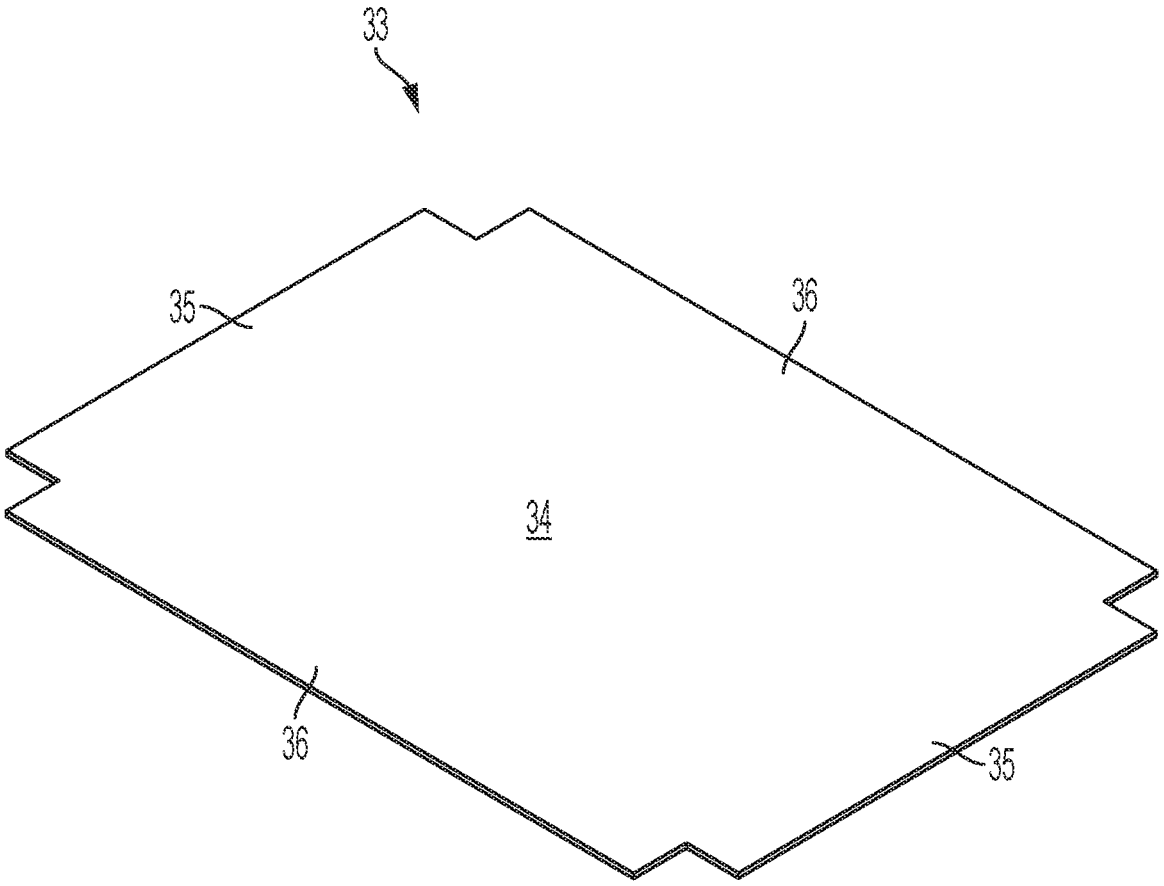
FIG. 3 PRIOR ART
FIG. 3 is a perspective view of a known lid blank for use by the system of FIG. 2 for closing a top side of the container of FIG. 1.

Referring now particularly to FIGS. 29 to 34, the lidding station 66 includes the lidding assembly 78 which applies a lid over the inwardly-folded flaps and secures the lid to the container 20 for shipment. The lid also may be referred to as a cap. The lids are formed from the planar lid blanks 33, such as that shown in FIG. 3. Exemplary lid blanks 33 have a generally rectangular shape main portion 34 that is approximately the size of the rectangular bottom wall 42 of the container 20 and cooperates with the inwardly-folded flaps to form a top wall of the container 20. Extending from each of the four sides of the generally rectangular main portion 34 are tabs 35 and 36, and include axial tabs 35 that correspond to the axial side walls 46 of the container 20 and transverse tabs 36 that correspond to the transverse side walls 48 of the container 20. The tabs 35 and 36 optionally may be separated from the main rectangular portion 34 by fold lines. Alternative shapes may be provided, however, such as rectangular lids that are secured to the inwardly-folded flaps only and not extending over or secured to the side walls 46 or 48.

The lidding assembly 78 includes a magazine 240 of lid blanks to draw from and an apparatus 242 for retrieving a lid blank from the magazine 240. In the illustrated embodiment, that apparatus 242 include a pivoting suction arm 244 that pulls lid blanks 33 from the magazine 240 and rotates the lid blank 33 from an upright orientation to a generally horizontal orientation. The apparatus 242 also includes a horizontally-movable carriage 246 with laterally-spaced hands 250 configured to grasp the lid blank 33 and move it to a lidding position above the container 20. As the carriage 246 moves from the magazine 240 toward the lidding position, adhesive dispensers 252 apply adhesive to the axial tabs 35 of the lid blank 33. The carriage 246 then moves the lid blank 33 vertically, down to the top of the container 20, for which the flaps have been folded inwardly, leaving the container 20 at the height of the fold lines. The lid blank 33 is secured to the container 20 by folding the tabs 35 and 36 down over respective side walls 46 and 48 of the container 20, whether fold lines are pre-applied or formed by the folding operation, and applying heat to activate the adhesive between the tabs 35 and 36 and the side walls 46 and 48. Recall that adhesive is applied to the axial tabs 35 by the lidding assembly 78, and adhesive is applied to the transverse side walls 48 of the container 20 by the gluing assembly 220 associated with the flap-folding assembly 74. Pivoting closers 260 fold the tabs 35 and 36 downward over the side walls 46 and 48 of the container 20. The pre-applied adhesive on the transverse side walls 48 of the container 20 binds the transverse tabs 36 to the transverse side walls 48, and the adhesive applied to the axial tabs 35 of the lid blank 33 bind the axial tabs 35 to the axial side walls 46. The container 20 is thus ready for labeling and shipment.

An exemplary system provided by the invention is expected to be able to process more than fifteen containers per minute.

In summary, the present invention provides a system 40 for closing a shipping container 20 that has an open top end 50 includes a sled 76 capable of moving the container 20 between a first station 62 and a second station 66 spaced from the first station 62, and a flap-folding assembly 74 movable with the sled 76. The flap-folding assembly 74 is configured to inwardly fold flaps of the container 20 while the sled 76 moves the container 20 between the first station 62 and the second station 66. The first station 62 may be a flap-forming station that forms flaps in upright side walls 46 and 48 of the container 20, and the second station may be a lidding station 66 that applies a lid over the inwardly-folded flaps and secures the lid to the container 20.

Although the invention has been shown and described with respect to a certain embodiment, equivalent alterations and modifications will occur to others skilled in the art upon the reading and understanding of this specification. The present invention includes all such equivalent alterations and modifications and is limited only by the scope of the following claims. Furthermore, the corresponding structures, materials, acts, and equivalents of all means or step plus function elements in the claims below are intended to include any structure, material, or acts for performing the functions in combination with other claimed elements as specifically claimed.

The invention claimed is:

1. A system for closing a shipping container, comprising:

a first station;

a second station spaced from the first station; and a sled capable of moving a container between the first station and the second station along a path extending in an axial direction, and a flap-folding assembly mounted to the sled and movable in the axial direction with the sled, the flap-folding assembly configured to inwardly fold flaps of the container while the sled moves the container between the first station and the second station;

wherein the flap-folding assembly includes opposing flap closers, the flap closers being spaced along the path and movable toward each other to inwardly fold flaps of the container; and wherein the flap-folding assembly is vertically adjustable relative to the sled.

2. The system as set forth in claim 1, wherein the first station includes a flap-forming assembly configured to form flaps from side walls of a container having a bottom wall and upright side walls extending from a periphery of the bottom wall to define an enclosed volume with an upwardly-opening top end.

3. The system as set forth in claim 1, wherein the second station is a container-closing station and optionally includes a lidding assembly configured to apply a lid to close the container, where the container has an upwardly-opening top end.

4. The system as set forth in claim 1, wherein the flap closers include axial flap closers and transverse flap closers coupled to the sled for movement with the sled, the transverse flap closers being spaced apart on opposing transverse sides of the path and movable toward each other to inwardly fold flaps perpendicular to the axial direction.

5. The system as set forth in claim 4, wherein the transverse flap closers are movable toward each other in a direction perpendicular to the axial direction.

6. The system as set forth in claim 4, wherein the transverse flap closers are pivotable toward each other about axes parallel to the axial direction.

7. The system as set forth in claim 6, wherein the transverse flap closers each include multiple fingers mounted on a common shaft that is pivotable about an axis parallel to the axial direction.

8. The system as set forth in claim 4, wherein the transverse flap closers are adjustable in a direction perpendicular to the axial direction.

* * * * *